US006783211B2

(12) United States Patent
Igaki et al.

(10) Patent No.: US 6,783,211 B2
(45) Date of Patent: Aug. 31, 2004

(54) INK-JET RECORDING HEAD

(75) Inventors: Emiko Igaki, Amagasaki (JP); Toru Ishida, Hirakata (JP); Masakazu Tanahashi, Osaka (JP); Hidetomo Nagahara, Ebina (JP); Kiyohide Amemiya, Fujisawa (JP); Masahiko Hashimoto, Tokyo (JP); Masayoshi Miura, Kawasaki (JP); Masaichiro Tatekawa, Mino (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/471,981

(22) Filed: Dec. 23, 1999

(65) Prior Publication Data

US 2002/0140780 A1 Oct. 3, 2002

(30) Foreign Application Priority Data

Dec. 25, 1998 (JP) ..... 10-368876
Dec. 25, 1998 (JP) ..... 10-368877

(51) Int. Cl.[7] ..... B41J 2/045

(52) U.S. Cl. ..... 347/68; 347/69; 347/70; 347/71; 347/72

(58) Field of Search ..... 347/68–72

(56) References Cited

U.S. PATENT DOCUMENTS 5,003,679 A 4/1991 Bartky et al. ..... 29/25.35
5,471,231 A * 11/1995 Hiraishi et al. ..... 347/68
5,592,042 A * 1/1997 Takuchi et al. ..... 310/328
5,631,680 A * 5/1997 Sugahara ..... 347/69
5,818,483 A * 10/1998 Mizutani ..... 347/72
6,095,641 A * 8/2000 Kishi ..... 347/71
6,097,412 A * 8/2000 Tsukada et al. ..... 347/68

FOREIGN PATENT DOCUMENTS

| | | | | |
|---|---|---|---|---|
| DE | 19742233 | | 6/1998 | B41J/2/45 |
| EP | 0227703 | A1 * | 8/1988 | B41J/3/04 |
| EP | 505188 | | 9/1992 | B41J/2/45 |
| EP | 0827833 | | 3/1998 | B41J/2/14 |
| JP | 63-160852 | | 7/1988 | |
| JP | 2-3311 | | 8/1990 | B41J/2/45 |
| JP | 4-126258 | | 4/1992 | B41J/2/45 |
| JP | 7-299904 | | 11/1995 | B41J/2/45 |
| WO | 0071345 | * | 11/2000 | |

OTHER PUBLICATIONS

European Search Report dated Oct. 23, 2000, application No. EP99125819.
Partial English translation of JP No. 2–3311.

* cited by examiner

*Primary Examiner*—Stephen D. Meier
*Assistant Examiner*—Ly T Tran
(74) *Attorney, Agent, or Firm*—RatnerPrestia

(57) ABSTRACT

An ink-jet recording head has nozzles capable of independent ejection and being arranged in high density, in which strength is high, fabricating yield is high, a cost is reduced, ejection efficiency is high, and ejection repeating frequency is high. In this ink-jet recording head, there are two-dimensionally arranged units, in each of which an ink pressure chamber, a partition wall serving as a driving portion, a pressure buffer chamber and a fixed wall are arranged in the same direction.

27 Claims, 18 Drawing Sheets

INK-JET RECORDING HEAD

BACKGROUND OF THE INVENTION

1. Field of the Invention

The present invention relates to an ink-jet recording head for use in an ink-jet printer for recording and imaging characters, graphics, images or the like on a recording medium.

2. Related Art of The Invention

In recent years, personal computers have been pervasive in the multimedia information society, and accordingly, demands for printers have greatly grown. Particularly, the market of an ink-jet printer is being expanded since the ink-jet printer can provide a color printout of high quality at a reduced cost.

The ink-jet printer includes various systems: a system in which mechanical vibration is converted into a pressure wave of ink by the use of a piezoelectric element so as to eject ink droplets; a system in which ink is abruptly heated to generate bubbles, a pressure wave of which ejects ink droplets; and a system in which electrostatic force attracts ink so as to allow the ink to spatter. Among these systems, the system using the piezoelectric element has come to widespread attention while a method for fabricating the piezoelectric element has progressed.

There has been proposed an ink-jet recording head having the configuration shown in FIG. 17 (for example, see Japanese Patent Laid-open No. Hei 2-3311). Here, the directions of a length, a width and a thickness are defined as shown in FIG. 17.

In the ink-jet recording head 101, pressure chambers 106 and cavities 108 are alternately arranged in a piezoelectric ceramics material 102 with a pair of driving electrodes 103 interposed therebetween. Ink supplied from an ink supplying portion 104 to the pressure chamber 106 through an ink introducing portion 105 is ejected from a nozzle hole 107.

In the ink-jet recording head having the above-described configuration, a voltage is applied to the driving electrode 103 interposed between the pressure chamber 106 and the cavity 108, thereby deforming the piezoelectric ceramics material. Ejection energy generated in this way can be propagated only to the pressure chamber adjacent to the deformed piezoelectric ceramics material, so that ink droplets can be simultaneously ejected from the adjacent nozzle.

Consequently, it is possible to independently control ejection of the ink from the nozzles, and further, to provide the ink-jet recording head in which the nozzles are arranged at a narrow pitch.

However, in the conventional ink-jet recording head as shown in FIG. 17, it is necessary to efficiently deform the piezoelectric ceramics material at the portion including the driving electrode in order to eject the ink and to thin the piezoelectric ceramics material between the pressure chamber 106 and the cavity 108 very much.

Therefore, there has arisen a problem that the piezoelectric ceramics material is weak from the structural viewpoint, thereby reducing the strength of the ink-jet recording head. This problem induces the difficulty of handling at the time of fabrication, with an attendant problem of reduced yield.

Moreover, in the structure of the conventional ink-jet recording head as shown in FIG. 17, it is necessary to deform two partition walls serving as driving portions (the piezoelectric ceramics portions including the driving electrodes) in order to eject the ink from one nozzle. Since at least two electrodes need be disposed at one partition wall serving as the driving portion, four electrodes in total are needed for one pressure chamber, i.e., for one nozzle. Expensive metal such as silver, palladium or platinum is used as the material of the electrode, thereby raising the problem of an increase in cost of the ink-jet recording head. Moreover, the increased number of electrodes induces problems that the number of connections to outside driving circuits is increased or that a narrow pitch makes connection to an outside circuit difficult.

Furthermore, with the above-described structure, the pressure chamber to be filled with the ink is constituted of mainly the thin piezoelectric ceramics material. Therefore, the rigidity of the pressure chamber becomes low. Part of the deformation energy generated at the piezoelectric ceramics material including the driving electrode is used to deform the wall of the pressure chamber, thereby raising a problem that efficiency of conversion into the ink ejecting energy becomes low.

Furthermore, if the rigidity of the wall defining the pressure chamber is low, the resonance frequency of the pressure chamber becomes low. Therefore, the ejection repeating frequency cannot be made high, thereby raising a problem of slow drawing.

Additionally, since the dimension of the piezoelectric ceramics material including the driving electrode markedly affects directly vibration characteristics in the ink-jet recording head, a slight error at the time of fabrication affects ejection characteristics, thereby raising a problem that ejection uniformity of the plurality of nozzles is deteriorated so as to degrade the quality of an image.

SUMMARY OF THE INVENTION

The present invention has been accomplished in an attempt to solve the above-described problems experienced by the conventional ink-jet recording head. An object of the present invention is to provide an ink-jet recording head in which the strength is high, fabricating yield is high and energy converting efficiency is high.

Furthermore, another object of the present invention is to provide an ink-jet recording head having the nozzle arranging structure capable of forming an image of high quality at high speed in the case where numerous nozzles are aligned in two dimensions.

An ink-jet recording head according to one aspect of the present invention comprises at least one piezoelectric block (A) having an ink pressure chamber communicating with a nozzle for ejecting ink to be supplied from an ink introducing portion, a partition wall serving as a driving portion including a piezoelectric element and at least two electrodes for driving said piezoelectric element, a pressure buffer chamber, and a fixed wall, wherein piezoelectric block (A) is configured such that said ink pressure chamber, said partition wall serving as the driving portion and said pressure buffer chamber are arranged in this order in the same direction, and said fixed wall is disposed adjacent to said ink pressure chamber and/or said pressure buffer chamber in reference to said the same direction.

An ink-jet recording head according to another aspect of the present invention comprises at least one piezoelectric block (B) having an ink pressure chamber communicating with nozzles for ejecting ink to be supplied from an ink introducing portion, partition walls serving as driving portions including piezoelectric elements and at least two electrodes for driving said piezoelectric elements, a pressure buffer chamber, and fixed walls, wherein said piezoelectric block (B) is configured such that a first ink pressure chamber, a first partition wall serving as a driving portion, said pressure buffer chamber, a second partition wall serving as a driving portion, and a second ink pressure chamber are arranged in the same direction, said fixed walls being disposed adjacent to said first ink pressure chamber and said second ink pressure chamber in reference to said the same direction.

An ink-jet recording head according to still another aspect of the present invention comprises:

at least one piezoelectric block (A) having an ink pressure chamber (A) communicating with a nozzle (A) for ejecting ink to be supplied from an ink introducing portion, a partition wall (A) serving as a driving portion including a piezoelectric element (A) and at least two electrodes (A) for driving said piezoelectric element (A), a pressure buffer chamber (A), and a fixed wall (A); and at least one piezoelectric block (B) having ink pressure chambers (B) communicating with nozzles (B) for ejecting ink to be supplied from an ink introducing portion, partition walls (B) serving as driving portions including piezoelectric elements (B) and at least two electrodes (B) for driving said piezoelectric elements (B), a pressure buffer chamber (B), and fixed walls (B), wherein said piezoelectric block (A) is configured such that said ink pressure chamber (A), said partition wall (A) serving as the driving portion and said pressure buffer chamber (A) are arranged in this order in the same direction, said fixed wall (A) is disposed adjacent to said ink pressure chamber (A) and/or said pressure buffer chamber (A) in reference to said the same direction, said piezoelectric block (B) is configured such that a first ink pressure chamber (B), a first partition wall (B) serving as a driving portion, said pressure buffer chamber (B), a second partition wall (B) serving as a driving portion, and a second ink pressure chamber (B) are arranged in the same direction, and said fixed walls (B) is disposed adjacent to said first ink pressure chamber (B) and said second ink pressure chamber (B) in reference to said the same direction.

As described above, according to the present invention, it is possible to provide the ink-jet recording head in which the structural strength is high, the durability is excellent, the low-voltage driving can be achieved owing to the high energy using efficiency, the high-frequency ejection can be achieved owing to the high rigidity of the pressure chamber, the printing of high quality can be achieved by the uniform ejection, the image can be formed at high resolution, and the cost can be reduced.

DESCRIPTION OF SYMBOLS

Figure 1:
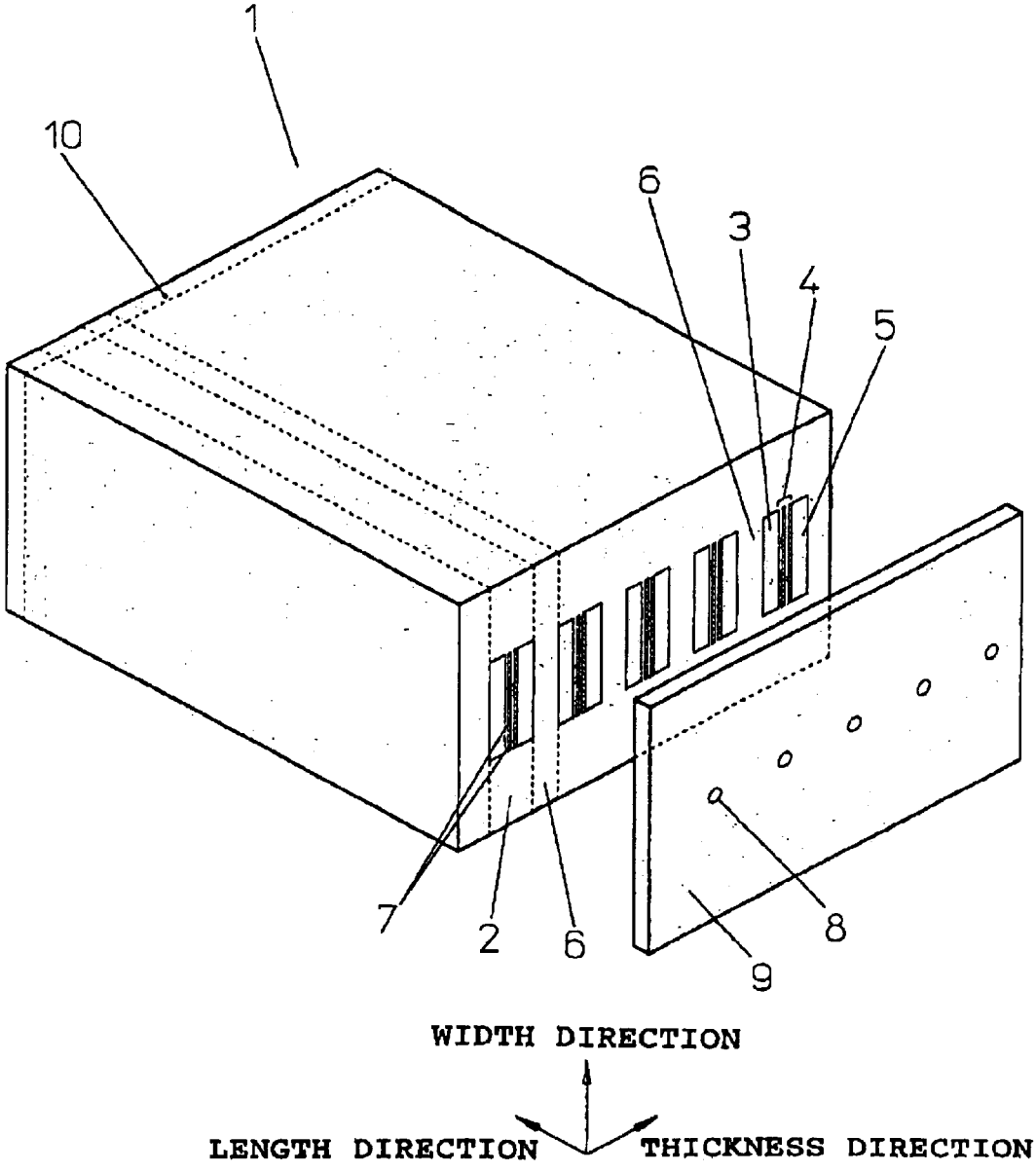
FIG. 1 is a perspective view showing an ink-jet recording head fabricated as one preferred embodiment according to the present invention.

1 Ink-jet recording head
2, 12, 22, 32, 42, 52 Piezoelectric block
3 Ink pressure chamber
3*a* First ink pressure chamber
3*b* Second ink pressure chamber
4 Partition wall serving as driving portion
4*a* First partition wall serving as driving portion
4*b* Second partition wall serving as driving portion
5 Pressure buffer chamber
6 Fixed wall
7, 7*a*, 7*b*, 17*a*, 17*b*, 17*c*, 27*a*, 27*b*, 27*c*, 37*a*, 37*b*, 37*c*, 47*a*, 47*b*, 47*c*, 47*d*, 47*e*, 57*a*, 57*b*, 67*a*, 67*b*, 77*a*, 77*b*, 77*c*, 77*d* Electrode
8 Nozzle
9 Nozzle plate
Ink introducing portion
14*a*, 24*a*, 24*b*, 34*a*, 34*b*, 44*a*, 44*b*, 44*c*, 54*a*, 54*b*, 64*a*, 64*b* Driving portion
14*b*, 24*c* Restricting portion

101 Ink-jet head
102 Piezoelectric ceramics material
103 Driving electrode
104 Ink supplying portion
105 Ink introducing portion
106 Pressure chamber
107 Nozzle hole
108 Cavity

DETAILED DESCRIPTION OF THE PREFERRED EMBODIMENTS

The piezoelectric block configuring the ink-jet recording head according to the present invention comprises: ink pressure chamber communicating with the nozzle for ejecting the ink supplied; the partition wall serving as the driving portion having the piezoelectric element and the electrodes for driving the piezoelectric element; and the pressure buffer chamber which is not full of the ink, wherein the ink pressure chamber and the pressure buffer chamber are arranged in the same direction with the partition wall serving as the driving portion interposed therebetween.

The arrangements of an ink pressure chamber, a partition wall serving as a driving portion, a pressure buffer chamber and a fixed wall in a piezoelectric block include the mode in which a fixed wall, an ink pressure chamber, a partition wall serving as a driving portion and a pressure buffer chamber are arranged in this order adjacently to each other in the same direction (hereinafter, this mode of piezoelectric block will be referred to as a piezoelectric block (A)); and the mode in which a piezoelectric block is composed of two ink pressure chambers, two partition walls serving as driving portions, one pressure buffer chamber and one fixed wall, wherein the fixed wall, the first ink pressure chamber, the first partition wall serving as the driving portion, the pressure buffer chamber, the second partition wall serving as the driving portion and the second ink pressure chamber are arranged in this order in the same direction (hereinafter, this mode of piezoelectric block will be referred to as a piezoelectric block (B)).

Here, FIG. 1 is a perspective view showing one example of an ink-jet recording head, in which a plurality of piezoelectric blocks are arranged in the same direction as those of ink pressure chambers and pressure buffer chambers. In FIG. 1, in the ink-jet recording head 1, piezoelectric blocks 2, each of which includes a fixed wall 6, an ink pressure chamber 3, a partition wall 4 serving as a driving portion having electrodes 7 and a pressure buffer chamber 5 are arranged in this order in the same direction, are arranged in the same direction as the arranging direction of the ink pressure chamber and the pressure buffer chamber.

To the front surfaces of the piezoelectric blocks 2 is welded a nozzle plate 9 having nozzles 8 facing the openings of the ink pressure chambers 3, respectively. At the back surfaces of the piezoelectric blocks 2 is formed an ink introducing portion 10. Furthermore, as shown in FIG. 1, the aligning direction of the nozzles is defined as a thickness direction; a direction perpendicular to the thickness direction with respect to the plane of the nozzle plate is defined as a width direction; and a direction perpendicular to the thickness and width directions is defined as a length direction.

The ink-jet recording head having numerous nozzles can print or draw an image at high speed. Consequently, it is preferable that the ink-jet recording head having numerous nozzles should be configured by arranging the plurality of piezoelectric blocks (A) or (B) in the same direction as the arranging direction of the ink pressure chamber and the pressure buffer chamber (i.e., the thickness direction) in the direction perpendicular to the arranging direction of the ink pressure chamber and the pressure buffer chamber and perpendicular to the longitudinal direction of the ink pressure chamber (i.e., the width direction), or in both the thickness and the width directions.

At this case, the ink-jet recording head may be configured by arranging either one kind of or both kinds of piezoelectric blocks (A) and the piezoelectric blocks (B).

In the case where the piezoelectric blocks (A) and (B) are block moldings integrally molded by baking powder including piezoelectric material, such advantages can be produced that assembling work is unnecessary so as to reduce the number of processes, that no adhesion is necessary so as to easily form a predetermined shape without any consideration of dimension of an adhesive layer, and that the rigidity of the entire ink-jet recording head inclusive of the ink pressure chamber or the partition wall serving as the driving portion can be enhanced.

In particular, in the case where the portion welded to the wall in the width direction of the partition wall serving as the driving portion is molded integrally with piezoelectric ceramics, such advantages can be produced that efficiency of conversion of distortion of the driving portion into the flexure of the partition wall serving as the driving portion can be enhanced, that since there is, no adhesive portion liable to markedly affect deformation characteristics, vibration characteristics of the plurality of partition walls serving as the driving portions can be made constant with ease.

Moreover, since there is no adhesive portion on the walls defining the ink pressure chamber so that the rigidity of the ink pressure chamber becomes high, ejection efficiency and ejection frequency become higher.

It is preferable that the integrally molded piezoelectric block should be prepared by kneading the powder of piezoelectric material with a binder such as a resin, so as to mold sheets, followed by baking a lamination formed by laminating and press-fitting the sheets.

Since the sheet-like piezoelectric material can be easily thinned, it is easy to increase the density of the nozzle alignment in the thickness direction, and further, the sheet including the powder of piezoelectric material before sintering can be easily processed, and therefore, can be easily fabricated, so that yield can be enhanced.

The piezoelectric block is made of material having a piezoelectric property, and is made of piezoelectric ceramics or piezoelectric single crystal. Examples of the piezoelectric ceramics include lead zirconate titanate, barium titanate, lead titanate or the like. Examples of piezoelectric single crystal include quartz, lithium niobate, monocrystalline lead zirconate titanate or the like.

In the case where the ink-jet recording head comprises two or more piezoelectric blocks, there are shown below modes of formation of the assembly of the piezoelectric blocks. In one mode, the piezoelectric blocks are not welded to each other but arranged independently of each other; and in the other mode, the piezoelectric blocks are welded to each other to form the assembly.

In order to not weld the piezoelectric blocks to each other but arrange them independently of each other, for example, there is a method for fixingly welding the plurality of piezoelectric blocks one by one to the nozzle plate or the ink introducing portion. Otherwise, there is a method for arranging some of the piezoelectric blocks and surrounding them with a frame or the like, and then, tightly fixing the arranged piezoelectric blocks with the frame.

These methods are preferable since the assembled piezoelectric block can be processed again if the interval between the ink pressure chambers is deviated in the once assembled ink-jet recording head.

In the meantime, in case of formation of the ink-jet recording head comprising the assembly of the piezoelectric blocks welded to each other, the piezoelectric blocks are bonded to each other via an adhesive made of epoxy or the like.

In order to provide the piezoelectric blocks welded by sintering, it is preferable that a lamination made of a sheet should be molded by kneading piezoelectric material powder with a binder, followed by baking.

Here, in the assembly of the piezoelectric blocks, the piezoelectric blocks are arranged in a plate form in the thickness or width direction or are arranged in a block form in the thickness and width directions; or the piezoelectric blocks are stepwise configured by arranging four piezoelectric blocks at a first step, three at a second step, and two at a third step.

The assemblies of the piezoelectric blocks may not be welded to each other but may be arranged independently of each other, or may be welded to each other via an adhesive. There are various modes of the arrangement of the assemblies of the piezoelectric blocks, and therefore, an optimum arrangement is appropriately used. For example, the assemblies of the piezoelectric blocks are arrayed in the thickness or width direction.

In either mode of the piezoelectric blocks (A) and (B), the partition wall serving as the driving portion is not deformed on the side opposite to the ink pressure chamber. Since it is unnecessary to deform such the fixed wall, it is possible to increase the length in the arranging direction of the ink pressure chamber and the pressure buffer chamber (hereinafter referred to as the thickness). Consequently, it is possible to enhance the strength of the piezoelectric block and the strength of the ink-jet recording head obtained by combining the piezoelectric blocks with each other.

Furthermore, it is also possible to enhance the strength of the ink-jet recording head during the fabricating processes, thereby facilitating handling and enhancing yield.

Moreover, the walls defining the ink pressure chamber become thick since the portion except the partition wall serving as the driving portion includes the fixed wall, so that the rigidity of the ink pressure chamber can be enhanced and mechanical energy generated on the partition wall serving as the driving portion can be converted into ejection energy without any loss so as to achieve the ejection at a low driving voltage.

Additionally, since the rigidity of the walls defining the ink pressure chamber is high, the resonance frequency of the ink pressure chamber per se becomes high, thereby increasing the ejection repeating frequency.

As described above, the thickness of the fixed wall is preferably increased within the allowable range of the nozzle aligning density.

When the fixed wall includes a portion firmer than the partition wall serving as the driving portion or the like, the strength of the ink-jet recording head can be further enhanced. For example, a plate is made of particles of piezoelectric ceramics which are bonded (sintered) at the density higher than that at the portion constituting the partition wall serving as the driving portion. The ceramics plate is interposed as the fixed wall. At this moment, it is much preferable that the length in the width direction of the ceramics plate (hereinafter referred to as the width) should be greater than that of the ink pressure chamber and the ink buffer chamber since the fixed wall functions as a strut.

A metallic plate made of stainless steel or the like may be used in place of the piezoelectric ceramics plate as described above. There may be used a plate, the strength of which is enhanced by mixing platinum particles with piezoelectric ceramics particles; or a plate which is made of ceramics having high strength such as alumina or zirconia other than the piezoelectric ceramics.

Additionally, if, for example, a hollow portion having substantially the same size as that of the pressure buffer chamber is formed at the fixed wall, the rigidity of the fixed wall is slightly decreased while the flexibility thereof is enhanced. Consequently, the tenacious fixed wall can be formed.

Furthermore, if a ceramics sintered plate is used as the fixed wall, the binder such as a resin which is kneaded in molding ceramics into a plate form can be removed with ease, thereby facilitating formation of the fixed wall without any honeycomb or crack therein.

Here, since the ink pressure chamber is filled with the ink, it need be completely empty immediately after fabrication of the ink-jet recording head. In the case where the ink is filled into the ink pressure chamber to be ejected from the nozzles, deformation energy of the partition wall serving as the driving portion is used only for compressing bubbles if the bubbles remain inside the ink pressure chamber. As a result, the ink cannot be ejected from the nozzles.

In order to fill the ink into the ink pressure chamber without allowing bubbles to remain therein, it is preferable that the inner wall of the ink pressure chamber should be provided with excellent wettability to the ink to be filled, or that the ink pressure chamber should be formed into a shape difficult for the bubbles to remain. In order to make the inside of the ink pressure chamber excellently wet with water ink, it is preferable that the inner surface of the ink pressure chamber should be covered with a hydrophilic film after sintering.

The ink pressure chamber in which no bubbles remain is preferably tapered toward the ink introducing portion and the nozzles.

The pressure buffer chamber functions not to propagate the ejection energy generated on the partition wall serving as the driving portion adjacent thereto to portions other than the ink pressure chamber adjacent thereto. Although basically, it is preferable that the pressure buffer chamber should be in the state in which there is nothing but air, it may be filled with some material in order to enhance the strength of the ink-jet recording head.

Examples of the material filled in the pressure buffer chamber in this case include materials having a great pressure buffer effect, such as foaming rubber or urethane foam.

In order to enhance a pressure buffer effect, it is desirable that the pressure buffer chamber should communicate with the outside via an air inlet path. The pressure buffer chamber communicates with the outside, thereby achieving a great pressure buffer effect.

In order to prevent any contamination caused by sucking the ink to be introduced into the ink pressure chamber adjacent to the pressure buffer chamber or the ink ejected from the nozzles, it is preferable that the pressure buffer chamber should not be opened on a side where the ink pressure chamber is opened.

In the case where the nozzle plate is stuck, it is preferable that the opening of the pressure buffer chamber should not be located on the side where the ink pressure chamber is opened so as to enlarge the welding area between the piezoelectric block and the nozzle plate. Consequently, the nozzle plate can be easily welded with accuracy.

In order that the opening of the pressure buffer chamber may not located on the side where the ink pressure chamber is opened, it is effective that the pressure buffer chamber or the ink pressure chamber is bent in such a manner that the pressure buffer chamber and the ink pressure chamber are exposed to different surfaces of the piezoelectric block.

The opening of the ink pressure chamber as it is used as the nozzle for ejecting the ink therefrom, or the nozzle plate having holes communicating with the ink pressure chambers is stuck to the surface at which the ink pressure chamber is opened.

In the case where the opening of the ink pressure chamber is used as the nozzle, since it is difficult to uniformly form the plurality of fine nozzles, normally, the nozzle plate in which the nozzles are formed independently is welded to the ink pressure chamber in such a manner that the nozzles correspond to the openings.

The nozzle plate is made of material which has high rigidity in order to enhance the rigidity of the ink pressure chamber and never chemically acts with the ink, preferably, such as ceramics, metal or resins.

There are various modes of arrangements of the electrodes for driving the piezoelectric element inside the partition wall serving as the driving portion. The portion in the partition wall serving as the driving portion at which the electrodes face each other functions as the piezoelectric element for generating the ink ejecting energy.

In the case where the number of electrodes disposed on one partition wall serving as the driving portion is two, in one of the preferable modes of the arrangements of the electrodes, one of the pair of electrodes is disposed inside the partition wall serving as the driving portion, while the other electrode is disposed at the surface exposed to the ink pressure chamber or the pressure buffer chamber in the partition wall serving as the driving portion.

In this way, the portion which is not interposed between the electrodes and is never distorted with application of a voltage (hereinafter referred to as a restricting portion) and the portion which is interposed between the electrodes and is distorted with application of the voltage (hereinafter referred to as the driving portion) are formed inside the partition wall serving as the driving portion, so that the flexing direction of the partition wall serving as the driving portion can be set uniquely owing to the polarity of the applied voltage and the polarizing direction of the driving portion, and the ink ejection can be freely controlled.

Particularly, the electrode to be exposed is preferably exposed to the pressure buffer chamber. This is because if the electrode is exposed to the ink pressure chamber, the electrode is liable to be degraded due to an electrochemical reaction with the ink or a deposit is produced from the ink to cause clogging in the nozzle.

In the other preferable mode of the arrangement of the electrodes, one of the electrodes is disposed apart from the ink pressure chamber with a predetermined distance (L1), the other electrode is disposed from the pressure buffer chamber with a predetermined distance (L2).

With this arrangement, the electrodes are housed inside the ceramics so as not to be brought into contact with the ink. Consequently, it is preferable that the electrodes cannot be separated or cannot electrochemically act with the ink. In this case, since the distances L1 and L2 are different from each other, it is possible to uniquely set the flexing direction of the partition wall serving as the driving portion owing to the polarity of the applied voltage and the polarizing direction of the driving portion, thereby freely controlling the ink ejection.

For example, assuming that L1>L2 in the case where the direction of the electric field is set in a direction in which the driving portion interposed between the pair of electrodes is contracted, the partition wall serving as the driving portion is flexed toward a direction in which the volume of the ink pressure chamber is decreased. To the contrary, in the case where the portion interposed between the electrodes is expanded, the partition wall serving as the driving portion is flexed toward a direction in which the volume of the ink pressure chamber is increased.

In this case, if the values L1 and L2 are approximate to each other, it is difficult that the flexure quantity of the partition wall serving as the driving portion becomes great. Therefore, it is preferable that the values L1 and L2 should be greatly different.

In particular, it is preferable that L1>L2. The ceramics between the ink pressure chamber and the electrode are thickened, so that the possibility of the contact between the ink and the electrode can be reduced, if anything should happen.

In anyone of the above-described modes of the electrodes disposed on the partition wall serving as the driving portion, one or more electrodes are interposed between the pair of electrodes housed inside the partition wall serving as the driving portion, thereby achieving the driving at a lower voltage.

In this case, the direction of the electric field and the polarizing direction are set in such a manner that the driving portion interposed between the plurality of electrodes are expanded or contracted in the same direction.

In a further preferable mode of the arrangement of the electrodes, a first electrode is disposed at the surface exposed to the ink pressure chamber of the partition wall serving as the driving portion, a second electrode is disposed inside the partition wall serving as the driving portion, and a third electrode is disposed at the surface exposed to the pressure buffer chamber of the partition wall serving as the driving portion.

In this case, there is no electrode inside the partition wall serving as the driving portion. Although only the first and third electrodes can allow the partition wall serving as the driving portion to be flexed, the flexing direction cannot be determined uniquely, Consequently, it is much preferable that the three electrodes including the above-described second electrode should be disposed.

With this arrangement of the electrodes, the partition walls serving as the driving portions bisected by the second electrode can be controlled to be expanded or contracted in directions opposite to each other, or to be expanded or contracted in different quantities in the same direct on. Consequently, it is possible to uniquely set the flexing direction of the partition wall serving as the driving portion, so as to freely control the ink ejection.

In the case where the partition walls serving as the driving portions bisected by the second electrode are expanded or contracted in directions opposite to each other, the polarity of the voltage between the electrodes an the polarizing directions of the driving portions are controlled in such a manner that, for example, the portion (a first driving portion) interposed between the first elect ode and the second electrode is expanded, while the portion (a second driving portion) interposed between the second electrode and the third electrode is contracted, the partition walls serving as the driving portions are flexed toward the ink pressure chamber so as to eject the ink.

It is possible to achieve great flexure at a voltage lower than that in the case where only the first driving portion is expanded or where only the second driving portion is contracted, so that the ink can be efficiently ejected.

In the case where the partition walls serving as the driving portions bisected by the second electrode are expanded in the same direction, for example, an expansion quantity of the first driving portion in contact with the ink pressure chamber is made greater than that of the second driving portion in contact with the pressure buffer chamber.

The directions of the voltages to be applied to the first and second driving portions and the polarizing directions are set in such a manner that the first and second driving portions are expanded at the same time. The strength of the electric field to be applied to the first driving portion is set to be greater than that of the electric field to be applied to the second driving portion, so that the partition walls serving as the driving portions are flexed toward the pressure chamber, thereby ejecting the ink.

In the same manner, the direction and strength of the electric field are set appropriately in the case where the first and second driving portions are contracted at the same time, thereby ejecting the ink.

Similarly in this mode of the arrangement of the electrodes, one or more electrodes may be interposed between the electrodes facing each other. In this case, the direction of the electric field and the polarizing direction are set in such a manner that the driving portion nearest the ink pressure chamber and the driving portion most nearest from the pressure buffer chamber are expanded or contracted in directions opposite to each other.

The driving portions partitioned by the electrode disposed inside the partition wall serving as the driving portion may be expanded or contracted in any direction or may not be expanded or contracted. It is much preferable that the direction of the electric field and the polarizing direction should be set in such a manner that the electrode is disposed at the center of the partition wall serving as the driving portion, and that the partition walls serving as the driving portions partitioned via the center electrode are deformed in the directions opposite to each other. Also in this case, the most efficient ink ejection can be achieved.

In the case where out of the electrodes arranged on the partition wall serving as the driving portion, the electrode exposed to the ink pressure chamber is grounded, no current flows in the ink by the applied voltage. Therefore, it is possible to prevent any occurrence of a problem such as exhaustion of the electrode or deposition of a dye caused by an electrochemical reaction generated when a current flows.

Figure 18:
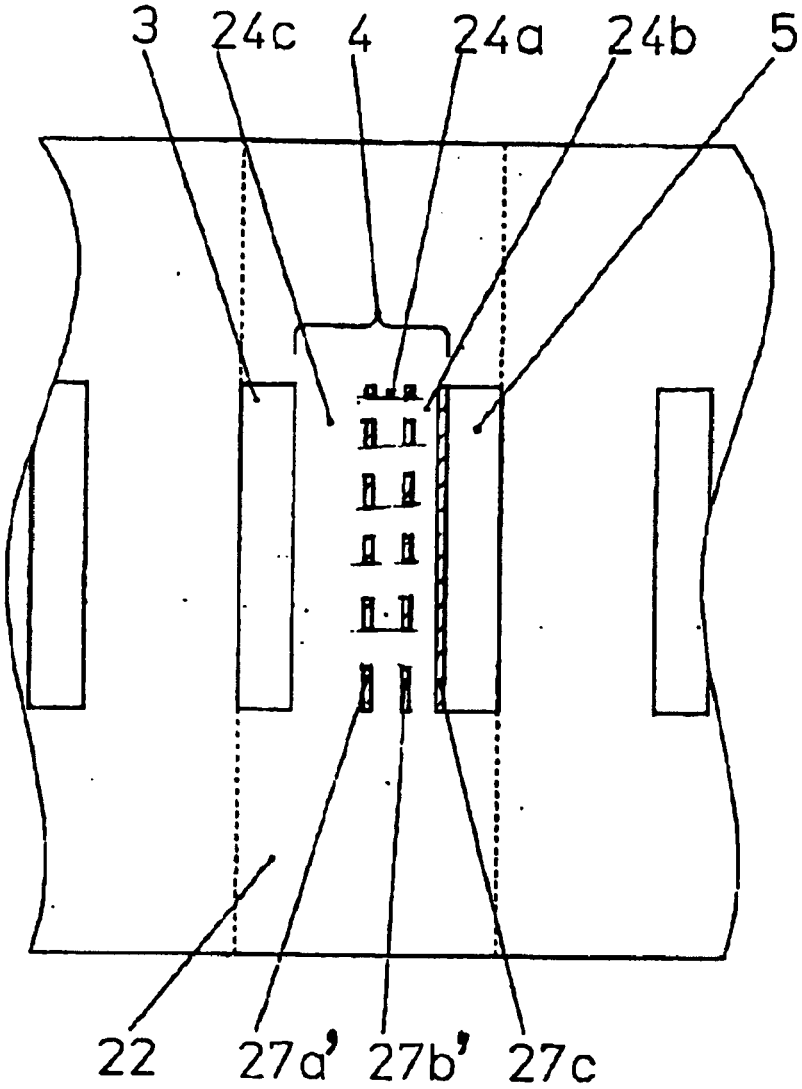
FIG. 18 is a cross-sectional view showing an ink-jet recording head fabricated as another embodiment of the present invention.

Furthermore, when all of the electrodes have mesh-like structure as shown in FIG. 18, the adjacent piezoelectric elements having the electrode interposed therebetween can be welded to each other through the mesh of the electrode 27*a*' and 27*b*', so as to further enhance the strength of the ink-jet recording head.

Also in the case of the electrode exposed to the ink pressure chamber or the pressure buffer chamber, it is possible to preferably alleviate distortion due to the difference in contraction ratio between the electrode and the piezoelectric ceramics at the time of sintering.

In order to form the electrode into a mesh shape, a mesh-like pattern is formed on a metal plate or a metal thin film, paste including an appropriately adjusted quantity of metal is printed in a predetermined thickness into a mesh shape at the time of sintering, or paste including particulate piezoelectric material mixed with electrode material is prepared and printed, or printed in a mesh form.

The electrode is made of material excellent in electric conductivity such as metal. Examples of usable metal include silver, palladium, gold and platinum.

In the ink-jet recording head having the above-described configuration, the partition wall serving as the driving portion distorted with application of the voltage between the electrodes ranges within the driving portion at which the electrodes face each other, wherein the partition wall serving as the driving portion is flexed by the distortion.

A quantity of the ink ejected from the nozzle is determined by a quantity of volumetric change generated by the flexure of the partition wall serving as the driving portion toward the ink pressure chamber. Therefore, it is preferable that the width at the portion at which the electrodes disposed on the partition wall serving as the driving portion face each other should become uniform at any portion of the partition wall serving as the driving portion.

In this manner, it is possible to make uniform a quantity of volumetric change of each of the ink pressure chambers, thereby achieving a uniform ink ejection quantity so as to draw an image of high quality.

Particularly, if the width of the portion at which the electrodes face each other is smaller than that of the portion at which the ink pressure chamber and the pressure buffer chamber face each other, the root of the beam structure on the partition wall serving as the driving portion cannot be markedly either deformed or moved. Consequently, the distortion generated between the electrodes on the partition wall serving as the driving portion can be converted into the flexure on the partition wall serving as the driving portion without any loss, thereby making the volumetric change in the ink pressure chamber.

If the width of one of the pair of electrodes on the partition wall serving as the driving portion is greater than that of the adjacent electrode, the width at the portion of the partition wall serving as the driving portion with application of the voltage is not changed even if the electrodes facing each other are slightly shifted in the width direction for a fabrication reason. Consequently, a distortion quantity of the driving portion, i.e., a flexure quantity of the partition wall serving as the driving portion becomes constant, thus making the quantity of the ink to be ejected from the nozzle uniform.

At this time, if one of the electrodes is included in the portion at which the ink pressure chamber and the pressure buffer chamber face each other and the other electrode is allowed to split the portion at which the ink pressure chamber and the pressure buffer chamber face each other, it is possible to provide the structure in which the ejection efficiency and the effect of ejection uniformity are easily achieved.

Moreover, if the thickness of the splitting electrode is greater than that of the adjacent electrode, the effect of the strut is further improved, thereby increasing the strength of the partition wall serving as the driving portion.

The portion at which the ink pressure chamber and the pressure buffer chamber face each other is the portion of the partition wall serving as the driving portion for generating flexure and substantially producing the volumetric change in the ink pressure chamber so as to eject the ink. If the width of the portion at which the ink pressure chamber and the pressure buffer chamber face each other is equal at any part of the partition walls serving as the driving portions, the vibration characteristics of the plurality of partition walls serving as the driving portions become uniform, so that the ink ejected from the plurality of nozzles can become uniform, thus drawing an image of high quality.

At this moment, if the width between the ink pressure chamber and the pressure buffer chamber which are adjacent to each other is different, a smaller one of the widths of the ink pressure chamber and the pressure buffer chamber becomes a width at the portion at which the ink pressure chamber and the pressure buffer chamber face each other even if either one of the ink pressure chamber and the pressure buffer chamber is slightly shifted in the width direction for a fabrication reason, thereby preventing any change in width of the beam which generates flexure of the partition wall serving as the driving portion.

If the distance between the nozzles communicating with the adjacent ink pressure chambers is constant in the thickness or width direction, the ink-jet recording head organ object to be printed (for example, a sheet of paper) in drawing can be moved at a constant speed or step, so that it is possible to simplify a mechanism for moving the ink-jet recording head and the object to be printed, or a scanning method.

In an ink-jet printer, the ink-jet recording head and the object to be printed (for example, a sheet of paper) are moved perpendicularly to each other at the time of drawing. In the ink-jet recording head in which the nozzles are aligned in the moving direction of the ink-jet recording head (a main scanning direction) and the m arrays of the nozzles aligned in the main scanning direction are arranged in a moving direction of the object to be printed (a sub-scanning direction), it is preferable that all the nozzles should be aligned without any mutual overlapping in the case of projection in the sub-scanning direction.

In this manner, it is possible to virtually enhance the nozzle aligning density so as to draw an image of high quality.

This can be achieved if $X \leqq P/m$, wherein X represents a deviation in the main scanning direction of one nozzle in an arbitrary nozzle array from another nozzle in a nozzle array nearest in the main scanning direction, m is an integer and P represents a pitch between the adjacent nozzles in one nozzle array. In the ink-jet recording head configured in this way, it is possible to align the nozzles projected in the sub-scanning direction at the highest aligning density. Consequently, it is possible to provide the ink-jet recording head capable of drawing an image of high quality.

At this moment, the nozzle aligning direction may be the same as or different from the arranging direction of the ink pressure chamber and the pressure buffer chamber: in the case of the same direction, it is preferable that the ink pressure chamber and the nozzles should be easily positioned, thereby securing the welding to the nozzle plate. However, in the case where the interval between the ink pressure chambers is slightly deviated from the interval between the nozzles caused by an error in view of fabrication, the nozzle aligning direction is deviated with an angle from the arranging direction of the ink pressure chamber and the pressure buffer chamber, so that all the nozzles can be aligned within the opening surfaces of the ink pressure chambers, thereby absorbing the error in view of fabrication.

Moreover, it is necessary to time wise delay an ink ejecting timing by the distance between the first alignment of the nozzles and the alignment of the nozzles adjacent to the first alignment of the nozzles.

Normally, the delayed timing is adjusted by changing the number of pulses in reference to a pulse signal corresponding to a recording resolution.

As to the recording resolution, since the same resolution is normally selected in the vertical and horizontal directions of the recording medium, the above mentioned deviation (X) determines the recording resolution.

If the distance in the sub-scanning direction between the first alignment of the nozzles and the second alignment of the nozzles adjacent to the first alignment of the nozzles is a multiple of the deviation (X) between the nozzles in the adjacent nozzle alignments, the ejecting timings of the nozzle alignments can be allowed to accord with each other in reference to the pulse corresponding to the recording resolution.

The present invention will be described below in more detail in reference to the accompanying drawings.

(First Embodiment)

A first embodiment according to the present invention will be described in reference to FIG. 1 which has been already referred to. The ink introducing portion 10 shown in FIG. 1 is partitioned into the same number as that of colors of inks.

The ink introducing portion 10 is integrally fabricated inside the piezoelectric block 2. Otherwise, the ink introducing portion 10 is fabricated separately from the piezoelectric block 2, and then, welded to the piezoelectric block 2.

The ink-jet recording head shown in FIG. 1 comprises a piezoelectric block 2 of the structure in which a fixed wall 6, an ink pressure chamber 3, a partition wall 4 serving as a driving portion having electrodes 7, and a pressure buffer chamber 5 are arranged in the same direction. The piezoelectric block configured in this way is referred to as a piezoelectric block (A). In this piezoelectric block, for example, piezoelectric ceramics powder is mixed with a binder, the resultant mixture is filled into a mold having a desired shape, and then, is removed from the mold, followed by baking. Alternatively, a die is molded with a burnable resin, thereby providing a piezoelectric block which is sintered by baking integrally with the mold.

In another fabricating method, the ink-jet recording head can be fabricated by a method for laminating piezoelectric ceramics green sheets.

On a fixed wall sheet, for example, are repeatedly laminated in a predetermined order a pressure chamber sheet in which a cavity for a pressure chamber corresponding to an ink pressure chamber is formed on a fixed wall sheet, a partition wall sheet serving as a driving portion in which electrodes are disposed by printing or transferring, and a pressure buffer chamber sheet in which a cavity for a pressure buffer chamber corresponding to a pressure buffer chamber is formed (this process is repeated five times in fabricating the ink-jet recording head shown in FIG. 1).

The sheets are bonded by heat or pressure, if necessary, followed by integrally baking, thereby providing the assembly of the piezoelectric blocks. A nozzle plate and an ink introducing portion, if necessary, are welded to the assembly of the piezoelectric blocks.

Figure 2A:
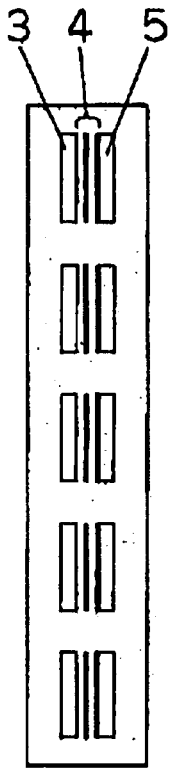
FIGS. 2(*a*), 2(*b*) and 2(*c*) are cross-sectional views showing an ink-jet recording head fabricated as another preferred embodiment according to the present invention.
Figure 2B:
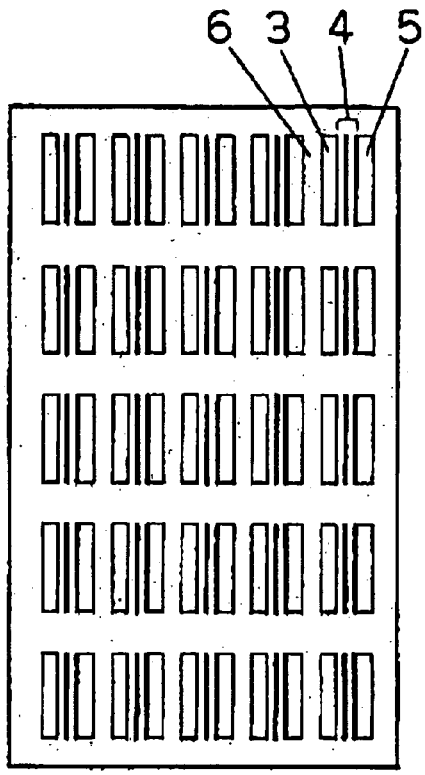
Figure 2C:
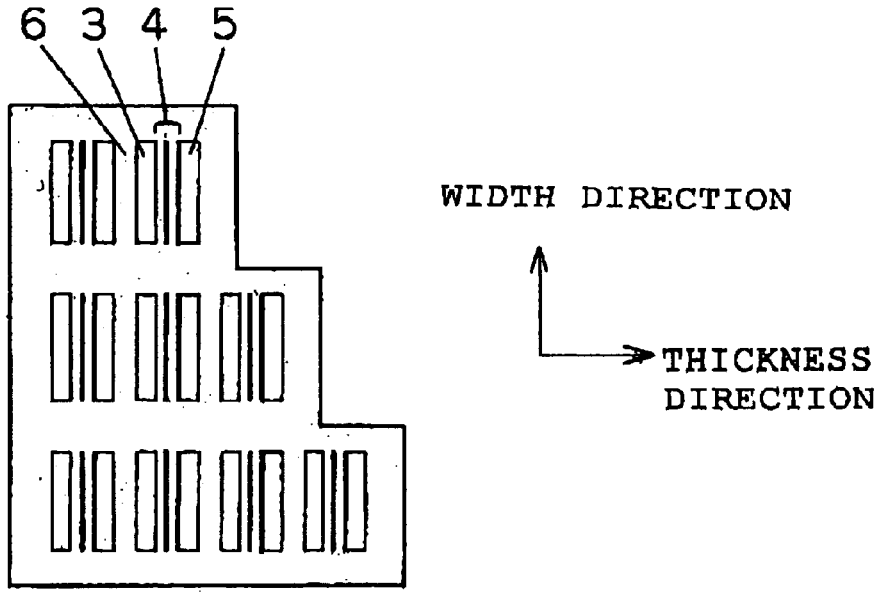

Although in FIG. 1 one array of piezoelectric blocks is arranged in the thickness direction so as to provide the ink-jet recording head, one array of piezoelectric blocks may be arranged only in the width direction, as shown in FIG. 2(*a*), the same number of arrays of piezoelectric blocks may be arranged in the thickness and width directions, as shown in FIG. 2(*b*), or the piezoelectric blocks may be arranged stepwise in the thickness and width directions, as shown in FIG. 2(*c*). Consequently, it is possible to increase the numbers of ink pressure chambers and nozzles communicating with the ink pressure chambers within a predetermined range, thereby producing the effect of an increase in drawing speed.

The ink-jet recording head composed of the plurality of piezoelectric blocks can be fabricated by integrally sintering ceramics, bonding the plurality of sintered piezoelectric blocks to each other via an adhesive, welding the piezoelectric blocks to the nozzle plate or the ink introducing portion in a predetermined order, or arranging the plurality of piezoelectric blocks so as to fix them as a whole via a frame.

One example of operation of the ink-jet recording head such configured as described above will be explained in reference to FIG. 3.

Figure 3:
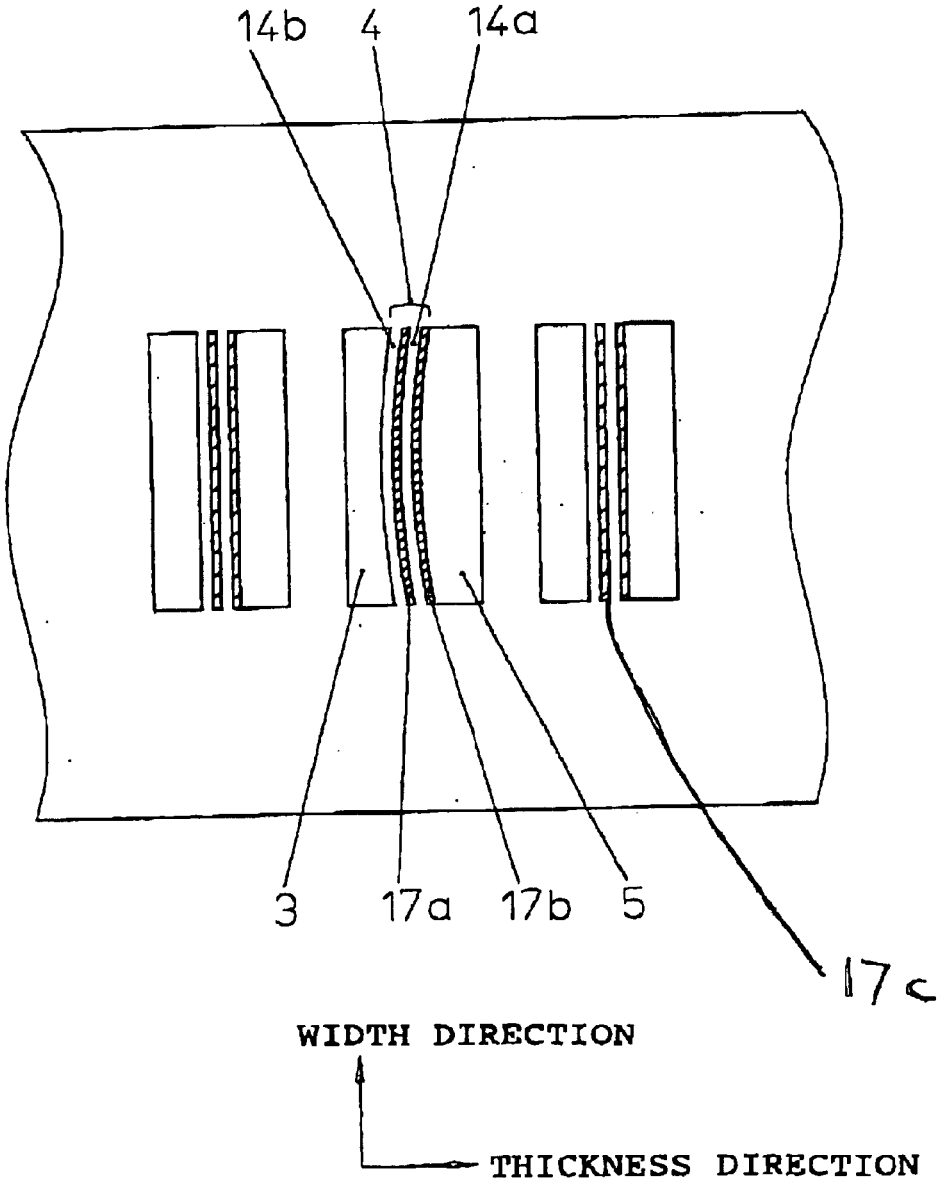
FIG. 3 is a cross-sectional view showing a method for operating the ink-jet recording head of FIG. 1.

When a voltage is applied between electrodes 17*a* and 17*b* in such a manner that a driving portion 14*a* held between the electrodes 17*a* and 17*b* is contracted in a width direction, a partition wall 4 serving as the driving portion is flexed to be expanded leftward, as shown in FIG. 3, due to a difference in distortion between the driving portion 14*a* and a restricting portion 14*b* since the restricting portion 14*b* not held between the electrodes 17*a* and 17*b* is not deformed, thereby reducing the volume of an ink pressure chamber 3. At this time, the ink filled in the ink pressure chamber 3 is pressed away by a quantity equivalent to the flexing deformation of the partition wall 4 serving as the driving portion, to be thus ejected from a nozzle 8 communicating with the ink pressure chamber.

Thereafter, when the voltage application is released, the partition wall serving as the driving portion is returned to the original position. At this moment, the inside of the ink pressure chamber comes into a vacuum by the quantity of the volume of the ink to be ejected in comparison with the atmospheric pressure, thereby generating force for sucking gas and liquid through the nozzle of the ink pressure chamber and the ink introducing portion.

However, outside gas can be prevented from intruding into the ink pressure chamber owing to the surface tension of the ink at the nozzle on the side of the ejection nozzle. With this effect, it is possible to eject the ink next time without any intrusion of bubbles into the ink pressure chamber through the nozzle.

If the bubbles intrude into the ink pressure chamber, the flexure energy of the partition wall serving as the driving portion is used to compress the bubbles, resulting in impossibility of ink ejection. In the meantime, the ink by the quantity to be ejected from the nozzle is introduced into the ink pressure chamber from the ink introducing portion, thereby making next ink ejection possible.

In this way, the flexing direction of the partition wall 4 serving as the driving portion can be set uniquely based upon the polarity of the voltage to be applied to the electrodes 17*a* and 17*b* and the polarizing direction of the driving portion 14*a*, thereby making it possible to freely control the ejection of the ink filled in the ink pressure chamber.

Although in FIGS. 1 to 3, the thickness of the ink pressure chamber is the same as that of the pressure buffer chamber, it is sufficient that the pressure buffer chamber has a space enough to allow the partition wall serving as the driving portion to be flexed. Therefore, the thickness of the pressure buffer chamber is reduced to narrow an arranging interval of the ink pressure chambers, so as to increase the nozzle arranging density.

The opening of the ink pressure chamber is formed in the same size as the diameter of an ejection hole in the case where no nozzle plate is welded, while an opening having a size larger than at least the diameter of the nozzle is needed in the case where a nozzle plate is welded.

Furthermore, in consideration of positional deviation generated in welding the nozzle plate or an overflow of an adhesive, it is preferable that an opening should have the thickness of about triple or more the nozzle diameter in the case where the diameter of the ejection nozzle ranges from about 20 μm to 30 μm.

(Second Embodiment)

Figure 4:
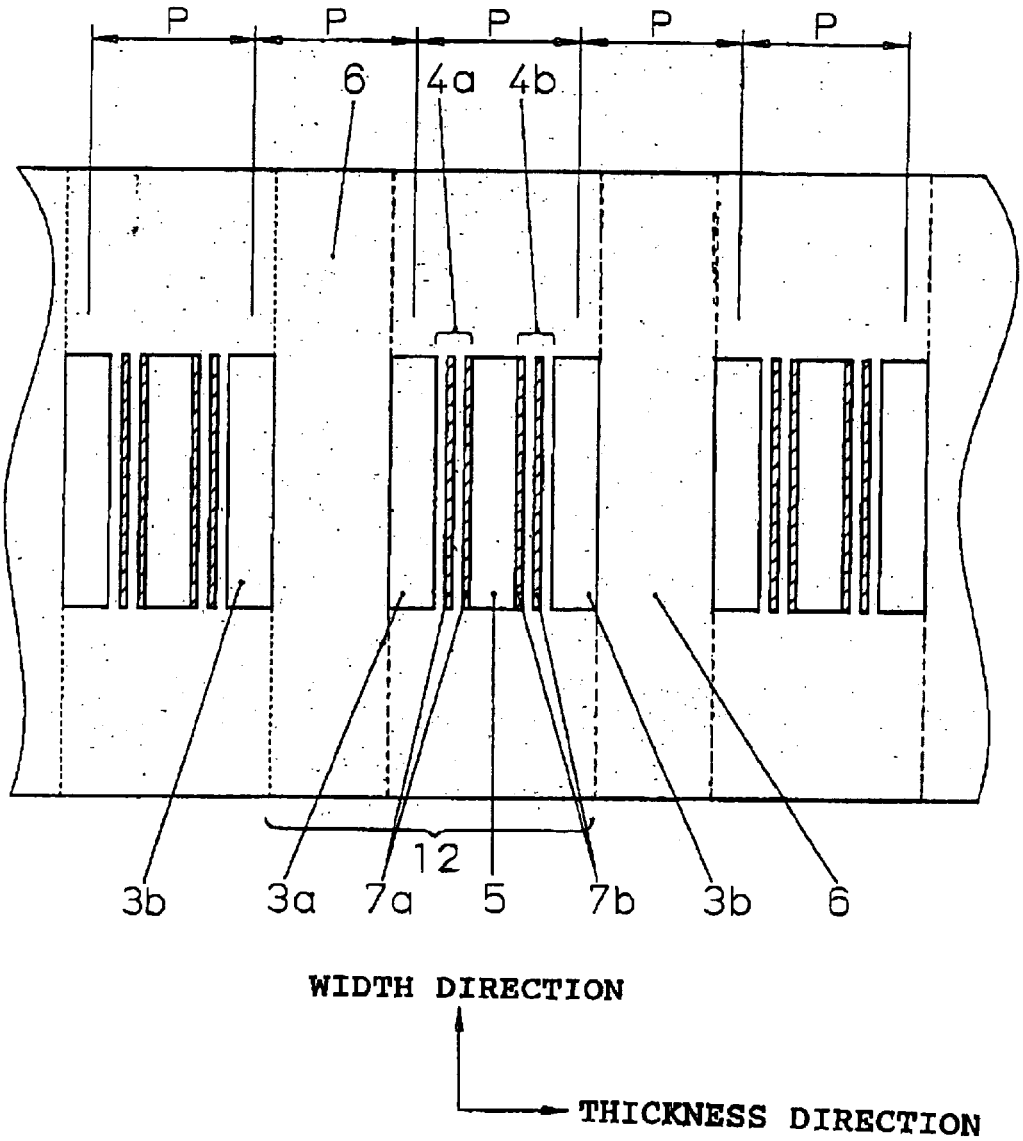
FIG. 4 is a cross-sectional view showing an ink-jet recording head fabricated as another preferred embodiment according to the present invention.

As shown in FIG. 4, an ink-jet recording head in a second embodiment comprises a piezoelectric block 12 including a first ink pressure chamber 3*a*, a first partition wall 4*a* serving as a driving portion having electrodes 7*a*, a pressure buffer chamber 5, a second partition wall 4*b* serving as a driving portion having electrodes 7*b*, a second ink pressure chamber 3*b*, and a fixed wall 6, all of which are arranged in the same direction.

The piezoelectric block having this configuration is referred to as a piezoelectric block (B). The ink-jet recording head is configured in the same manner as the first embodiment except the use of the piezoelectric block (B). In the case of the piezoelectric block (B), the pressure buffer chamber 5 is used commonly by the first and second ink pressure chambers 3*a* and 3*b*. The piezoelectric block (B) is symmetric with respect to the center of the pressure buffer chamber.

In the present embodiment, as shown in FIG. 4, in the case where the nozzles communicating with the ink pressure chambers are arranged at equal pitches P, a thick fixed wall 6 can be interposed between the second ink pressure chamber 3*b* in the most left side piezoelectric block 12 and the first ink pressure chamber 3*a* in the central piezoelectric block 12, thereby enhancing the rigidity of the ink-jet recording head and enhancing reliability.

During the fabricating processes, the strength of the ink-jet recording head becomes high so as to facilitate handling and enhance yield. Moreover, in the case where the nozzles communicating with the ink pressure chambers are not aligned at equal pitches, the nozzle aligning density can be further increased.

For example, if the thicknesses of the ink pressure chamber, the partition wall serving as the driving portion and the pressure buffer chamber are, set to 80 μm, 60 μm and 80 μm, respectively, the interval of the nozzles communicating with the ink pressure chambers is 280 μm in the arranging direction of the ink pressure chamber and the pressure buffer chamber, so that the thickness of the fixed wall is 200 μm.

If in the ink-jet recording head fabricated in the first embodiment, the thicknesses of the ink pressure chamber, the partition wall serving as the driving portion and the pressure buffer chamber and the interval of the nozzles are set the same as described above, the thickness of the fixed wall becomes 60 μm.

Figure 5:
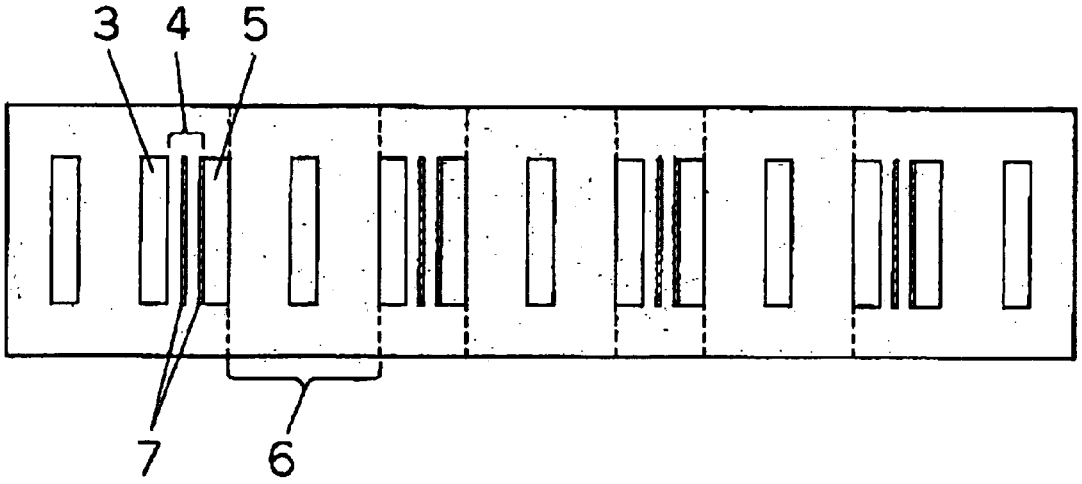
FIG. 5 is a cross-sectional view showing an ink-jet recording head fabricated as another preferred embodiment according to the present invention.

Furthermore, when a hollow portion is formed on the fixed wall, as shown in FIG. 5, the pressure energy generated on the partition wall serving as the driving portion is propagated to the fixed wall through the ink although the strength of the fixed wall is weakened slightly, so that distortion generated inside the fixed wall can be alleviated even if such distortion is generated on the fixed wall, whereby the fixed wall is hardly broken. Moreover, if the fixed wall is made of ceramic powder kneaded with a resin, the resin can be easily removed, thereby shortening a time required for fabrication. Additionally, it is possible to prevent any generation of an unexpected nest or a crack inside the fixed wall so as to enhance yield, thus reducing a fabricating cost of the ink-jet recording head.

(Third Embodiment)

Figure 6:
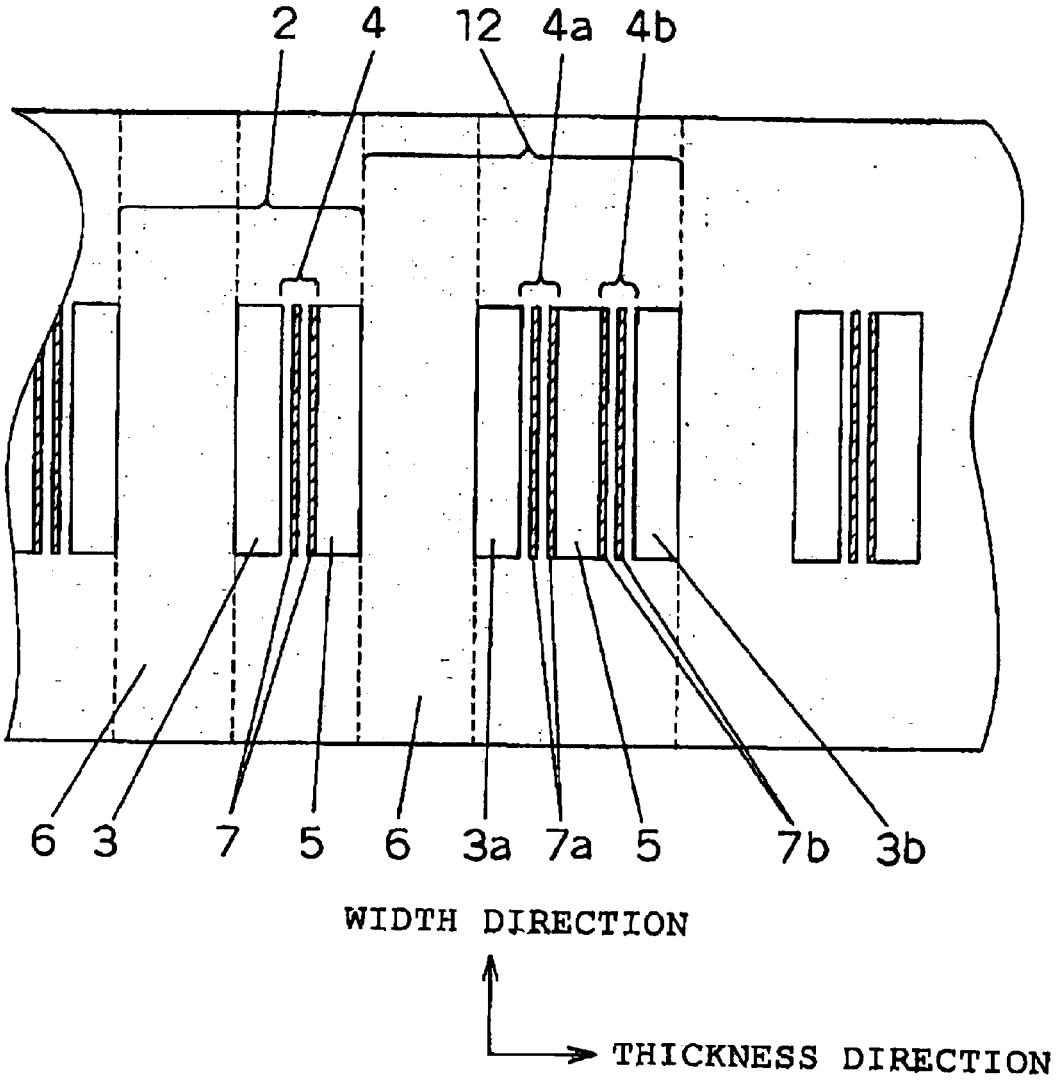
FIG. 6 is a cross-sectional view showing an ink-jet recording head fabricated as another preferred embodiment according to the present invention.

As shown in FIG. 6, an ink-jet recording head in a third embodiment according to the present invention is configured in the same manner as the first embodiment except that piezoelectric blocks 2 and other piezoelectric blocks 12 are combined with each other, wherein the piezoelectric block 2 includes an ink pressure chamber 3, a partition wall 4 serving as a driving portion having electrodes 7, a pressure buffer chamber 5, and a fixed wall 6, all of which are laminated in the same direction and the piezoelectric block 12 includes a first ink pressure chamber 3*a*, a first driving portion 4*a* having electrodes 7*a*, a pressure buffer chamber 5, a second driving portion 4*b* having electrodes 7*b*, a second ink pressure chamber 3*b*, and a fixed wall 6, all of which are laminated in the same direction.

The piezoelectric blocks 2 and 12 are arranged in the thickness direction with fixed walls 6 held therebetween. The effect produced in the present embodiment is the same as those described in the first and second embodiments.

(Fourth Embodiment)

Figure 7:
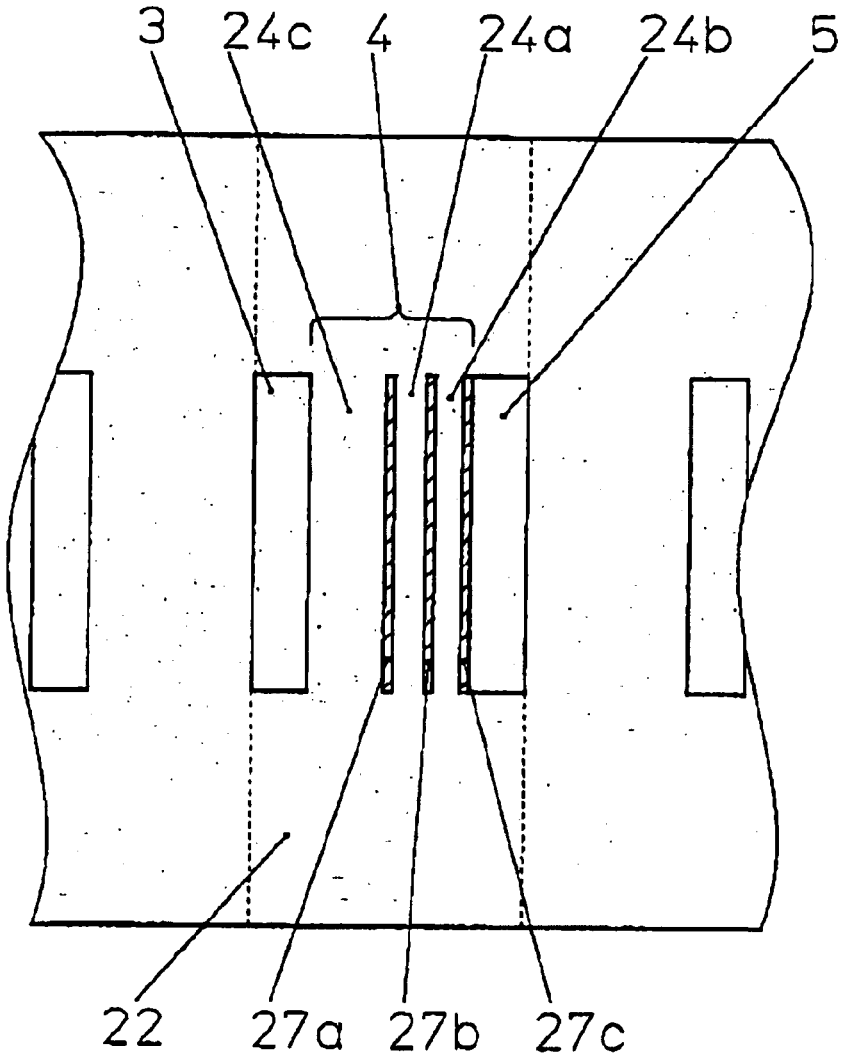
FIG. 7 is a cross-sectional view showing essential parts of an ink-jet recording head fabricated as another preferred embodiment according to the present invention.

An ink-jet recording head in a fourth embodiment according to the present invention is configured in the same manner as the first embodiment except that another piezoelectric block 22 having three electrodes is fabricated in the partition wall 4 serving as the driving portions in the piezoelectric block 2 in the first embodiment. As shown in FIG. 7, the three electrodes 27*a*, 27*b* and 27*c* are disposed in the partition wall serving as the driving portions. The electrode 27*b* is grounded or is used as a driving electrode, and the electrodes 27*a* and 27*c* holding the electrode 27*b* therebetween have a polarity opposite to that of the electrode 27*b*. A voltage is applied between the electrodes in such a manner that the driving portions 24*a* and 24*b* are deformed in the same direction.

When the polarizing directions of the driving portions 24*a* and 24*b* are set opposite to each other to contract the driving portions 24*a* and 24*b* together, the partition wall 4 serving as the driving portions is flexed toward an ink pressure chamber 3 to compress the ink pressure chamber 3 since a restricting portion 24*c* is not deformed.

In the present embodiment, since the distance between the electrodes becomes about ½ in comparison with that in the first embodiment, the strength of the electric field becomes twice with application of the same voltage, so that the driving voltage for obtaining the deformation required for the ink ejection becomes about ½.

Although as shown in FIG. 7, all of the three electrodes are disposed only rightward of the center of the partition wall serving as the driving portions, the electrode 27*a* may be disposed anywhere except the surface exposed to the ink pressure chamber as long as the electrode 27*c* is exposed to a pressure buffer chamber of the partition wall serving as the driving portions and the electrode 27*b* is interposed between the electrodes 27*a* and 27*c*. The same effect can be produced even if the electrodes 27*a*, 27*b* and 27*c* are disposed at positions other than those shown in FIG. 7.

(Fifth Embodiment)

An ink-jet recording head in a fifth embodiment according to the present invention is configured in the same manner as the first embodiment except that electrodes are disposed at the surface of a partition wall serving as driving portions exposed to an ink pressure chamber, at the inside of the partition wall serving as the driving portions and at the surface of the partition wall serving as the driving portions exposed to a pressure buffer chamber.

Figure 8:
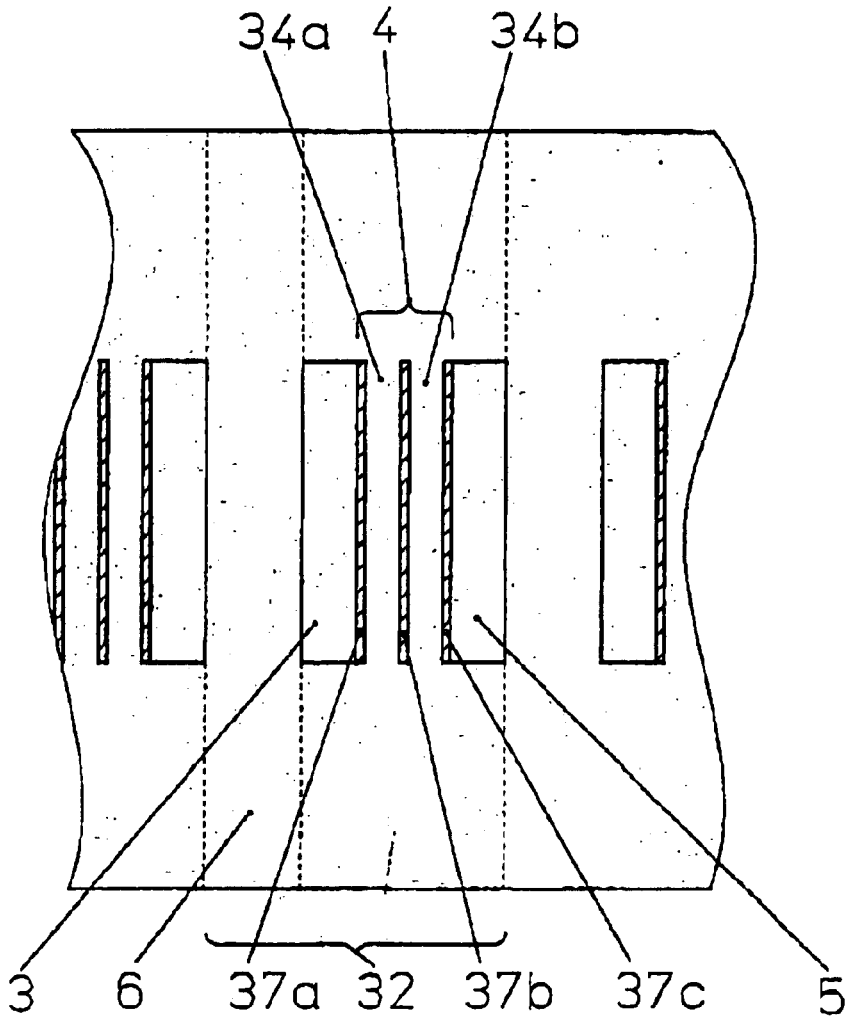
FIG. 8 is a cross-sectional view showing essential parts of an ink-jet recording head fabricated as another preferred embodiment according to the present invention.

As shown in FIG. 8, the electrode 37*a* is disposed at the surface of the partition wall 4 serving as the driving portions exposed to the pressure chamber 3; the electrode 37*c* is disposed at the surface of the partition wall 4 serving as the driving portions exposed to the pressure buffer chamber; and the electrode 37*b* is interposed between the electrodes 37*a* and 37*c*.

A voltage is applied between the electrodes in such a manner that a driving portion 34*a* held between the electrodes 37*a* and 37*b* is expanded while another driving portion 34*b* held between the electrodes 37*b* and 37*c* is contracted, thereby flexing the partition wall 4 serving as the driving portions so as to compress the ink pressure chamber 3.

With this arrangement, it is possible to increase the flexure of the partition wall 4 serving as the driving portions so as to further cause a volumetric change of the ink pressure chamber 3. At this moment, if the electrodes 37*a* and 37*c* function as grounding electrodes and the electrode 37*b* functions as a driving electrode, no current flows in the ink filled into the ink pressure chamber 3, thereby suppressing deterioration of the ink and generating deposit from the ink due to an electrochemical reaction so as to prevent any clogging in the nozzle.

In the structure in which the electrodes are arranged as shown in FIG. 8, the ink ejection can be controlled by expanding or contracting the driving portions 34*a* and 34*b* at the same time. In the case where the driving portions 34*a* and 34*b* are expanded at the same time, an expansion of the driving portion 34*a* is made more than that of the driving portion 34*b*, so that the partition wall serving as the driving portions is flexed toward the ink pressure chamber, thereby ejecting the ink.

To the contrary, in the case where the driving portions are contracted at the same time, a contraction of the driving portion 34*a* is made less than that of the driving portion 34*b*, so that the partition wall serving as the driving portions is flexed toward the ink pressure chamber.

In this way, in order to make the expansion or contraction of the driving portions partitioned by the electrode different, it is sufficient to make different the driving voltage to be applied between the electrodes disposed on the partition wall serving as the driving portions and the strength of the electric field determined based on the distance between the electrodes.

Specifically, for example, in the case where the driving portions 34*a* and 34*b* are expanded at the same time, the polarity of the applied voltage and the polarizing direction are set appropriately, and the strength of the electric field applied between the electrodes 37*a* and 37*b* at both ends of the driving portion 34*a* is set smaller than the strength of the electric field applied between the electrodes 37*b* and 37*c* at both ends of the driving portion 34*b*.

Also in the case where the driving portions are contracted at the same time, the ink can be ejected in the same manner as described above.

(Sixth Embodiment)

Figure 9:
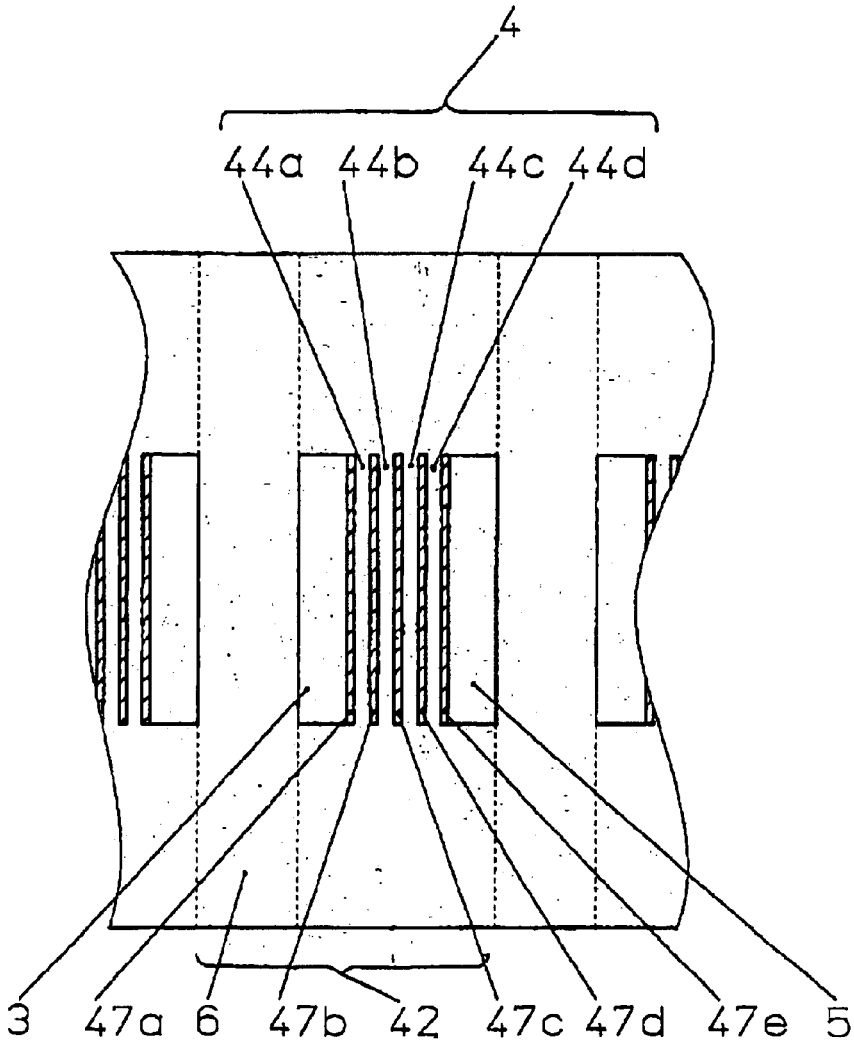
FIG. 9 is a cross-sectional view showing essential parts of an ink-jet recording head fabricated as another preferred embodiment according to the present invention.

An ink-jet recording head in a sixth embodiment according to the present invention is configured in the same manner as the fifth embodiment except that five electrodes are disposed at a partition wall serving as driving portions to fabricate a piezoelectric block 42. As shown in FIG. 9, five electrodes 47*a* to 47*e* are disposed in the partition wall 4 serving as the driving portions.

In the same manner as in the fifth embodiment, a voltage is applied between the electrodes to expand or contract driving portions 44*a* to 44*d* in such a manner that the partition wall serving as the driving portions is flexed to cause a volumetric change in the ink pressure chamber 3. Here, some of the driving portions may not be deformed.

In this way, the plurality of electrodes are disposed at the partition wall serving as the driving portions, thus achieving the driving at a low voltage.

The same effect can be produced also when the present embodiment is applied to the electrode at the driving portion in the ink-jet recording head in which no electrode is exposed to the ink pressure chamber.

(Seventh Embodiment)

Figure 10:
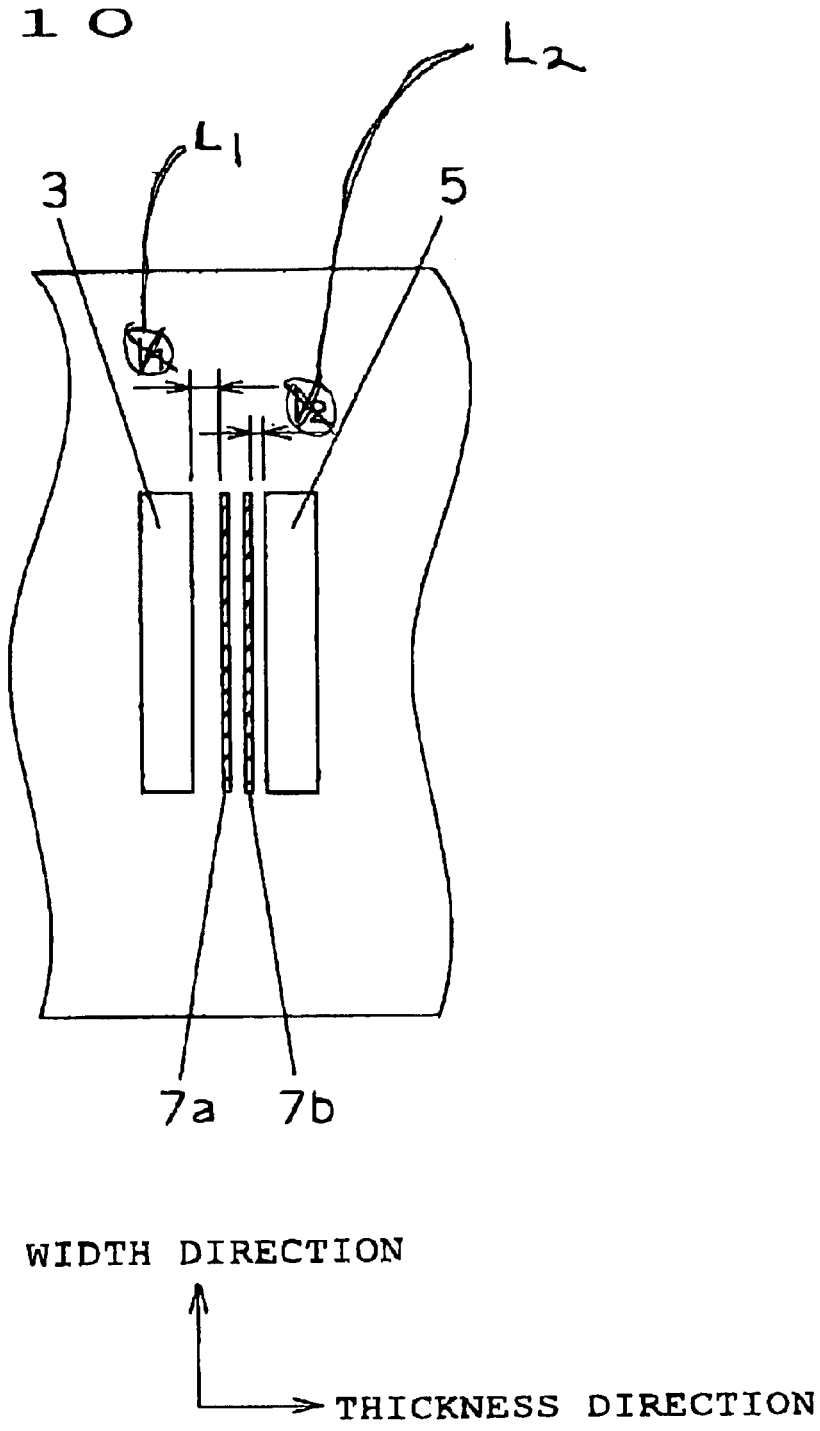
FIG. 10 is a cross-sectional view showing essential parts of an ink-jet recording head fabricated as another preferred embodiment according to the present invention.

An ink-jet recording head in a seventh embodiment according to the present invention is configured in the same manner as the first embodiment except that an electrode on a partition wall serving as a driving portion is disposed by distances L1 and L2 apart from an ink pressure chamber and a pressure buffer chamber inside the partition wall serving as the driving portion. As shown in FIG. 10, an electrode 7*a* nearer the ink pressure chamber 3 is positioned at the distance L1 apart from the ink pressure chamber; another electrode 7*b* nearer the pressure buffer chamber is positioned at the distance L2 apart from the ink buffer chamber. With this arrangement, the electrodes cannot be exposed outside the ink pressure chamber or the ink buffer chamber but stay inside the ceramics, which can prevent any peeling of the electrode or functions as a cover for the ink, thereby enhancing the reliability of the ink-jet recording head.

In this case, since the distances L1 and L2 are different from each other, it is possible to uniquely set the flexing direction of the partition wall 4 serving as the driving portion, thereby freely stopping the ink ejection. In particular, if L1>L2, the distance from the ink pressure chamber to the electrode becomes long, so that an electrochemical reaction is hardly caused by the interaction between the electrode and the ink. Consequently, it is possible to enhance the reliability of the ink-jet recording head without any deterioration of the electrode or the ink.

(Eighth Embodiment)

Figure 11:
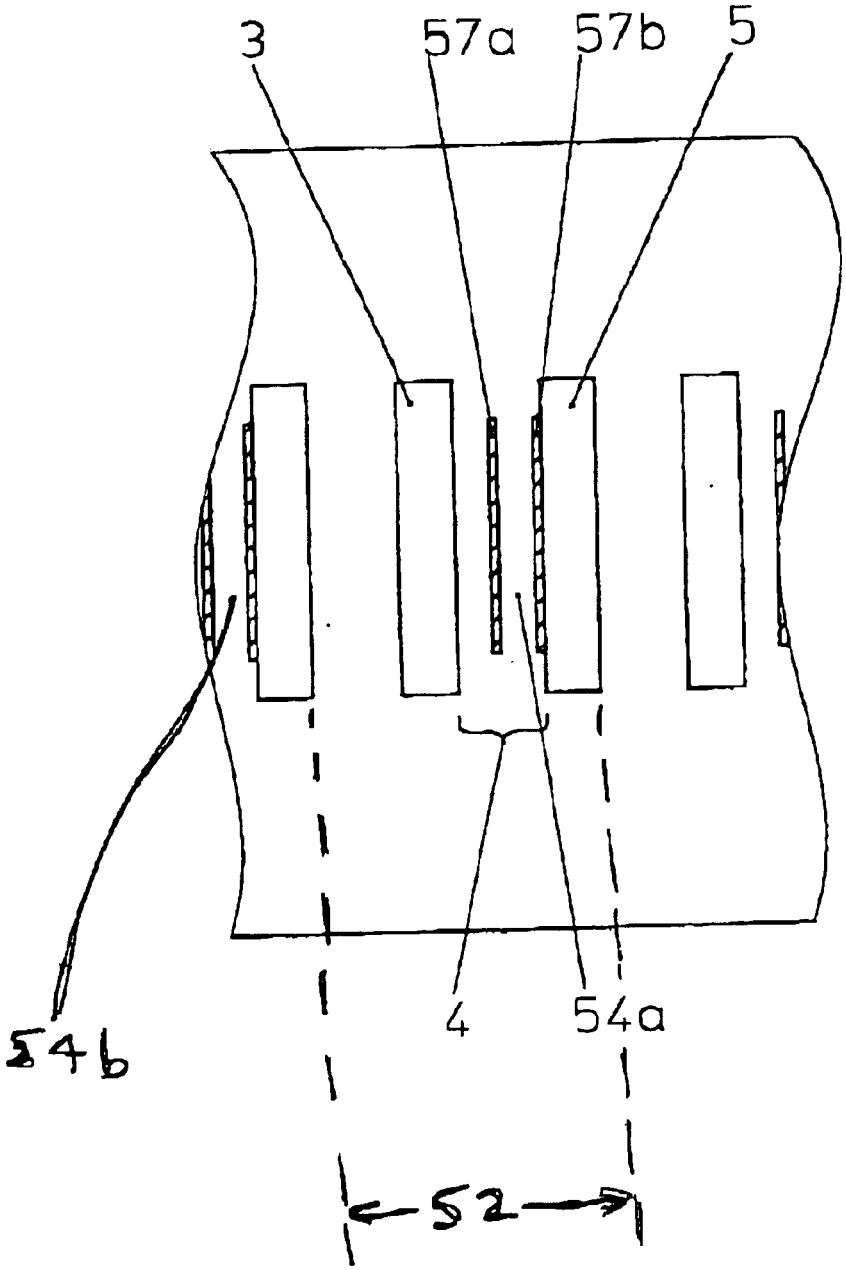
FIG. 11 is a cross-sectional view showing essential parts of an ink-jet recording head fabricated as another preferred embodiment according to the present invention.

An ink-jet recording head in a eighth embodiment according to the present invention is configured in the same manner as the first embodiment except that the width of an electrode is smaller than those of an ink pressure chamber and a pressure buffer chamber. As shown in FIG. 11, the width of each of the electrodes 57*a* and 57*b* is less than those of the ink pressure chamber 3 and the pressure buffer chamber 5.

With this arrangement, a portion which is deformed with application of a voltage is narrower than the ink pressure chamber and the pressure buffer chamber. Since a root of a beam is not largely moved or deformed but fixed when a partition wall 4 serving as a driving portion is flexed, the deformation of a driving portion 54*a* is efficiently converted into a flexure of the partition wall 4 serving as the driving portion, thereby making a volumetric change in the ink pressure chamber 3 so as to efficiently eject the ink at a low voltage.

(Ninth Embodiment)

Figure 12:
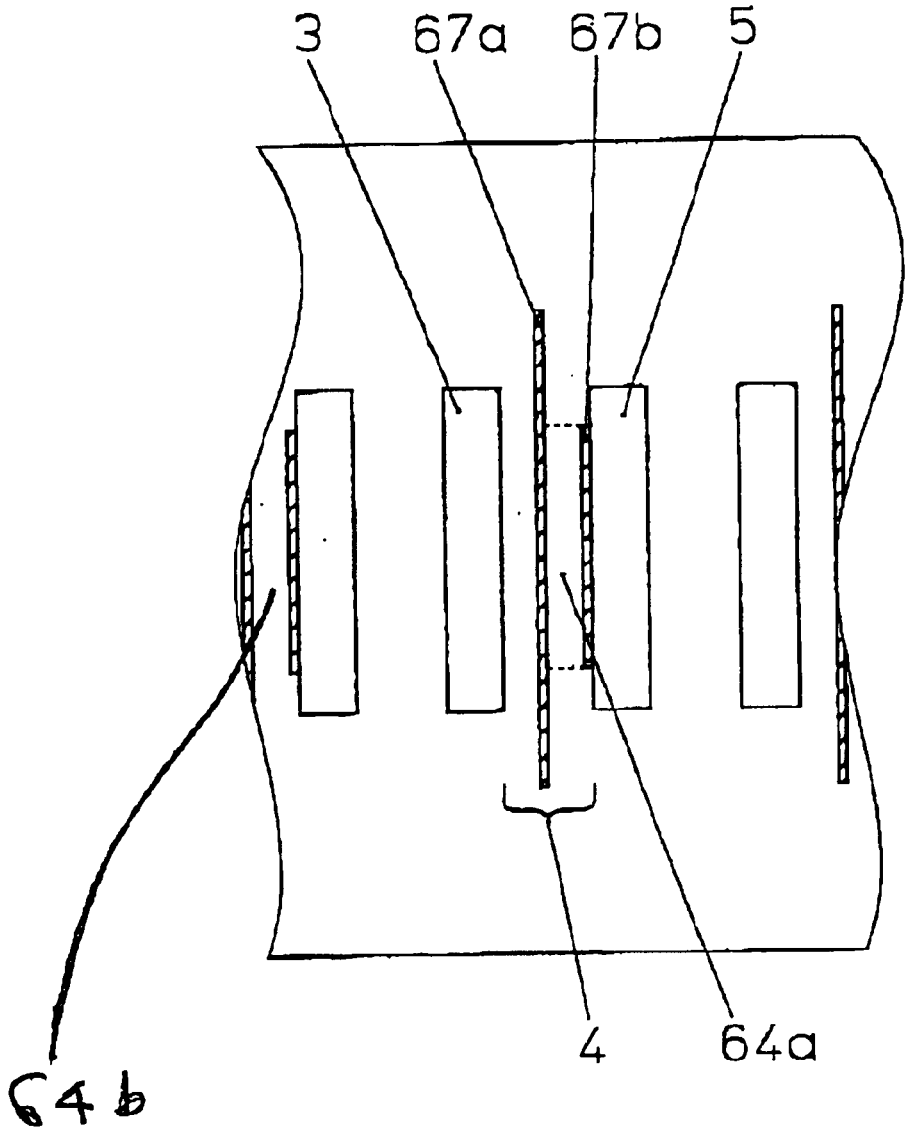
FIG. 12 is a cross-sectional view showing essential parts of an ink-jet recording head fabricated as another preferred embodiment according to the present invention.

An ink-jet recording head in an ninth embodiment according to the present invention is configured in the same manner as the first embodiment except that the width of one of electrodes facing each other is greater than the width of the other electrode. As shown in FIG. 12, the electrodes 67*a* and 67*b* are disposed at a partition wall 4 serving as a driving portion.

The width of the electrode 67*a* is greater than those of the ink pressure chamber 3 and the pressure buffer chamber 5; in the meanwhile, the width of the electrode 67*b* is smaller than those of the ink pressure chamber 3 and the pressure buffer chamber 5.

With this arrangement, since there exist portions where are fixed without any application of an electric field on both sides in a width direction in the case where the partition wall 4 serving as the driving portion is flexed as a beam, ink can be efficiently ejected at a low voltage for the same reason as that in the eighth embodiment.

Furthermore, the electrode 67*a* long in the width direction functions as a strut for the partition wall serving as the driving portion, thereby enhancing the strength of the partition wall serving as the driving portion and ensuring high reliability.

Moreover, since the width of the driving portion 64*a*, to which a voltage is applied, is not changed even if the positions of the electrodes 67*a* and 67*b* are slightly deviated in the width direction within the range where the ink pressure chamber and the pressure buffer chamber face with an error in view of fabrication, a flexure of the partition wall serving as the driving portion becomes constant, thereby making a quantity of ink to be ejected from each nozzle uniform.

In the case where a plurality of electrodes are disposed at the partition wall serving as driving portions, the width of one of the adjacent electrodes is made smaller while the width of the other electrode is made greater, thereby producing the same effect.

With respect to the depth direction on the drawing sheet of FIG. 12, i.e., the length direction, one of the pair of electrodes is made longer while the other electrode is made shorter, so that the fabricating error is absorbed in the same manner, and therefore, the length of a portion to which an electric field is applied is made constant, thereby producing the effect of uniform ink ejection.

(Tenth Embodiment)

Figure 13A:
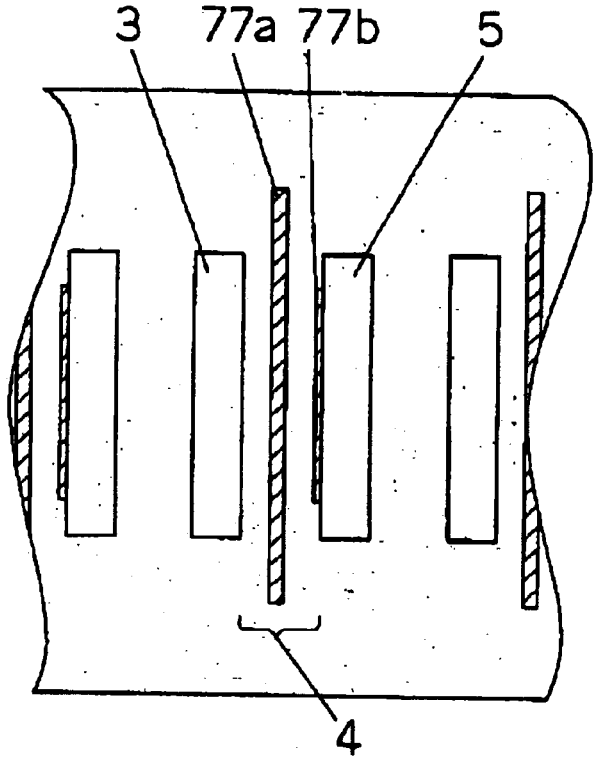
FIGS. 13(*a*) and 13(*b*) are cross-sectional views showing essential parts of an ink-jet recording head fabricated as another preferred embodiment according to the present invention.
Figure 13B:
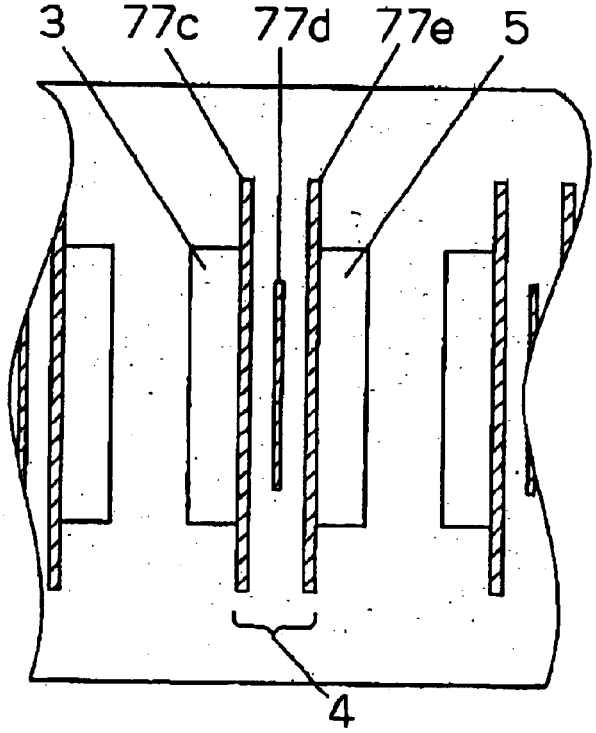

An ink-jet recording head in a tenth embodiment according to the present invention is configured in the same manner as the first embodiment except that the width and thickness of one of electrodes facing each other are greater than those of the other electrode. As shown in FIG. 13(*a*), the electrodes 77*a* and 77*b* are disposed on a partition wall 4 serving as a driving portion. The width and thickness of the electrode 77*a* is greater than those of the electrode With this arrangement, since the wider and thicker electrode 77*a* functions as a strut for the partition wall 4 serving as the driving portion which is likely to be deteriorated due to its thinness and repeated deformation, the strength of the partition wall 4 serving as the driving portion can be enhanced. Therefore, the strength of the ink-jet recording head can be enhanced.

The same effect can be produced even if the width and length of the electrodes 77*a* and 77*b* are in the relationship reverse to that shown in FIG. 13(*a*). As shown in FIG. 13(*b*), in the structure in which three electrodes 77*c*, 77*d* and 77*e* are disposed on the partition wall 4 serving as the driving portions, the width and thickness of one of each of the pairs of electrodes, i.e., the electrodes 77*c* and 77*e* are made greater than those of the electrode 77*d*, thereby enhancing the strength of the partition wall 4 serving as the driving portions.

Here, in FIG. 13(*b*), the same effect can be produced even if the relationship between the electrodes 77*c* and 77*e* and the electrode 77*d* is reverse to that described above.

The strength of the partition wall 4 serving as the driving portion can be increased by thickening a longer one out of the pair of electrodes in a depth direction on the drawing sheet of FIG. 13, i.e., a length direction.

(Eleventh Embodiment)

Figure 14A:
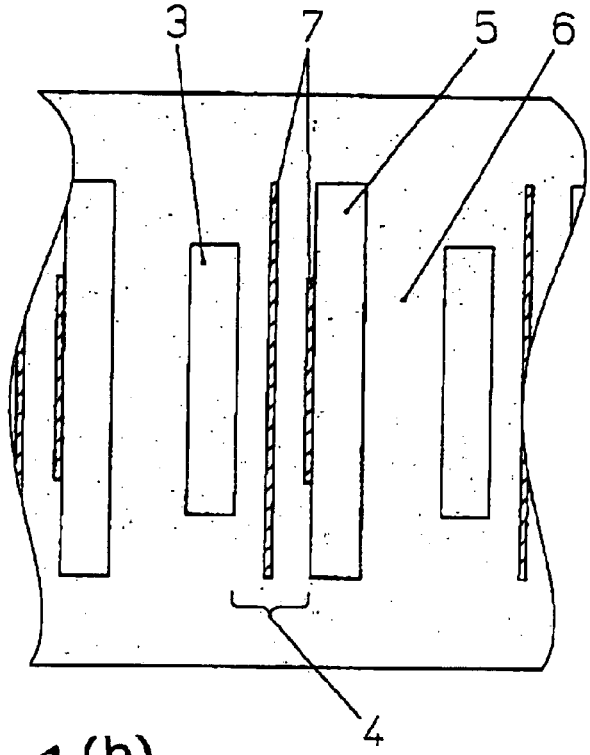
FIGS. 14(*a*) and 14(*b*) are cross-sectional views showing essential parts of an ink-jet recording head fabricated as another preferred embodiment according to the present invention.
Figure 14B:
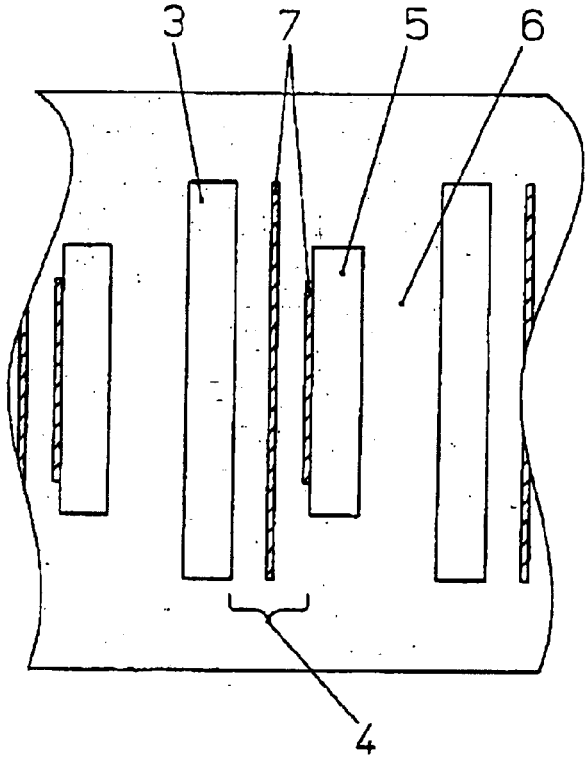

An ink-jet recording head in a eleventh embodiment according to the present invention is configured in the same manner as the first embodiment except that the width of an ink pressure chamber is different from that of a pressure buffer chamber. As shown in FIG. 14(*a*), the width of the pressure buffer chamber 5 is greater than that of the ink pressure chamber 3.

With this arrangement, even if the positions of the ink pressure chamber 3 and the pressure buffer chamber 5 are deviated within the width range of the pressure buffer chamber 5 due to a fabricating error, the width of a portion flexed as a beam of a partition wall 4 serving as a driving portion is not changed.

Consequently, a flexure of each of the plurality of partition walls serving as the driving portions becomes constant all the time, so that a quantify of ink to be ejected from each of nozzles becomes uniform. The same effect can be produced also in the case where the ink pressure chamber 3 is longer than the pressure buffer chamber 5, as shown in FIG. 14(*b*).

(Twelfth Embodiment)

Figure 15:
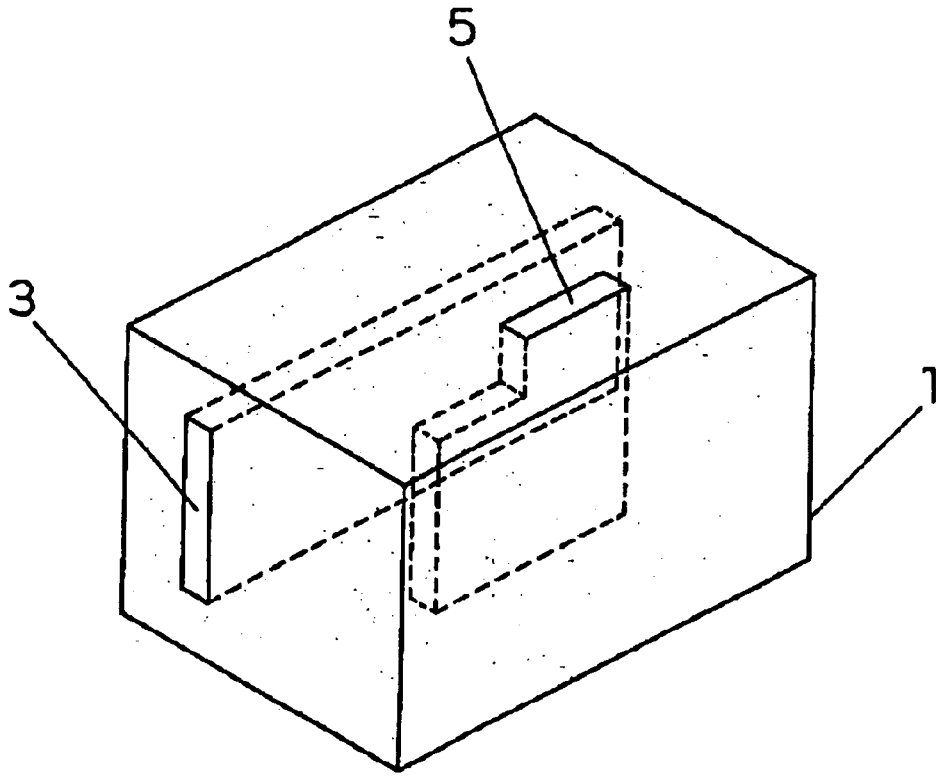
FIG. 15 is a perspective view showing essential parts of an ink-jet recording head fabricated as another preferred embodiment according to the present invention.

An ink-jet recording head in a twelfth embodiment according to the present invention is configured in the same manner as the first embodiment except that an opening surface of a pressure buffer chamber is not exposed to an opening surface of an ink pressure chamber. As shown in FIG. 15, the pressure buffer chamber cannot be opened toward an ink introducing portion and a nozzle, thereby preventing any contamination caused by suction of ink or the like ejected from the nozzle.

In the case where a nozzle plate is welded to the opening surface of the ink pressure chamber, it is possible to provide the large welded surface between the nozzles and the body since there is no opening of the pressure buffer chamber on the same plane, thereby securing the welding work with ease. Furthermore, it is possible to enhance the ejection reliability without any suction of the ink leaked from the nozzle by the pressure buffer chamber.

(Thirteenth Embodiment)

Figure 16A:
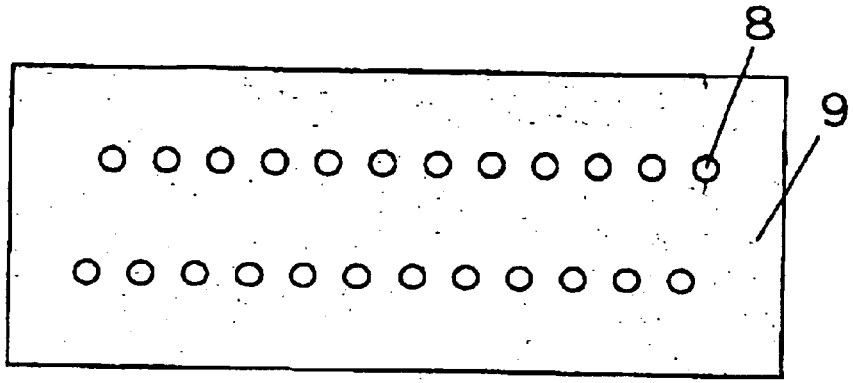
FIGS. 16(*a*) and 16(*b*) are views showing a nozzle part of an ink-jet recording head fabricated as another preferred embodiment according to the present invention.
Figure 16B:
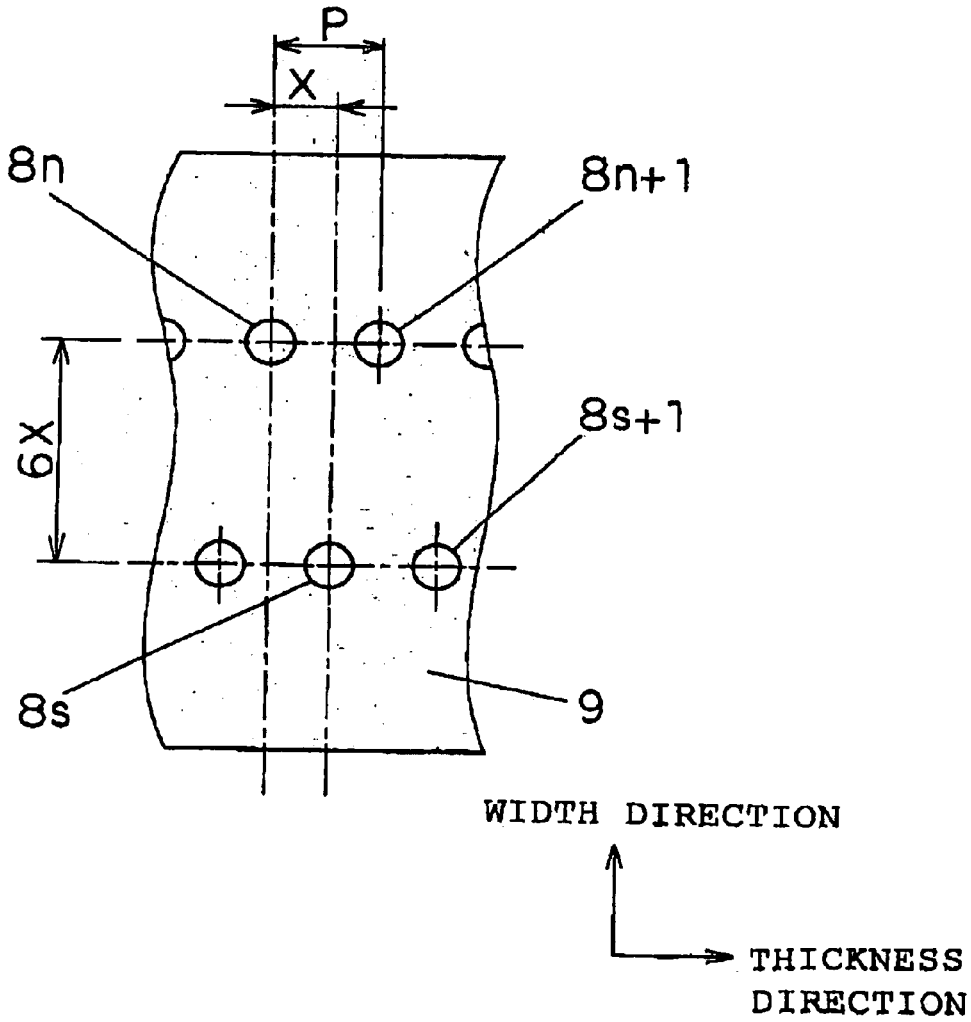
Figure 17:
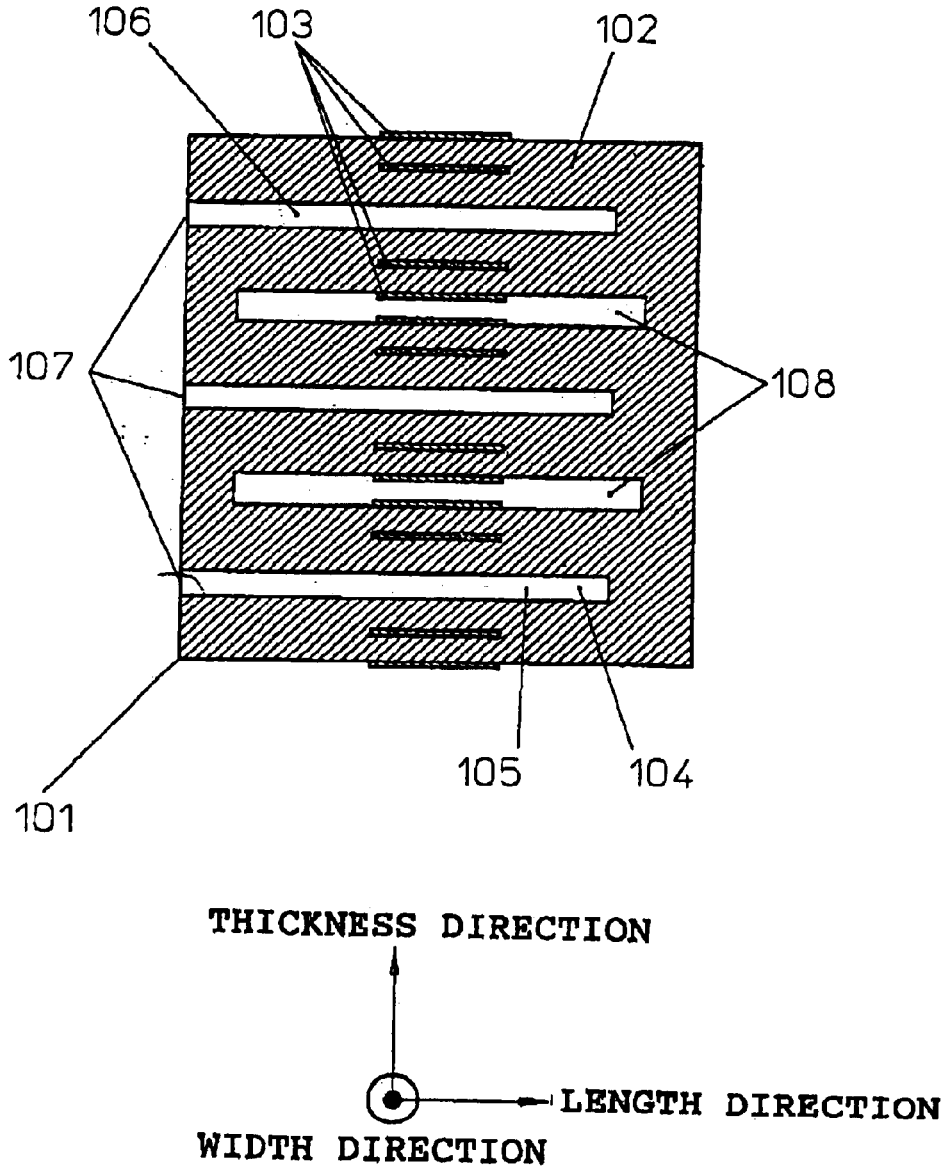
FIG. 17 is a cross-sectional view showing an ink-jet recording head in the prior art.

An ink-jet recording head in a thirteenth embodiment according to the present invention is configured by arranging m, i.e., two of the ink-jet recording heads fabricated in the first embodiment in a width direction. FIGS. 16(*a*) and 16(*b*) are views showing the obtained ink-jet recording head, as viewed from a nozzle. FIG. 16(*b*) is an enlarged view showing essential parts of FIG. 16(*a*). Here, the thickness direction shown in FIG. 16 is assumed to be the same as a direction in which the ink-jet recording head in an ink-jet printer is moved. The n-th nozzle from the left in an upper array in the ink-jet recording head shown in FIG. 16 is defined as the nozzle 8*n*, and a nozzle nearest the nozzle 8*n* out of the nozzles in a lower array in the thickness direction is defined as the nozzle 8*s*.

The interval between the nozzles in both of the upper and lower arrays is a constant value P. A deviation (X) in the nozzle aligning direction between the n-th nozzle 8*n* from the left in the upper array and the s-th nozzle from the left in the second array becomes, for example, $X=\frac{1}{3}\cdot P$. The distance between the upper nozzle array and the lower nozzle array becomes, for example, 6X.

With this arrangement, it is possible to efficiently align the nozzles, so as to provide the ink-jet recording head excellent in resolution. Furthermore, it is possible to make constant the moving step or speed of an object to be printed (for example, a sheet of paper) in the ink-jet printer, to simplify the scanning mechanism for the ink-jet printer so as to enhance the reliability of the ink-jet printer, and to reduce the cost.

The same effect can be produced in the ink-jet recording heads in which the piezoelectric blocks 12 fabricated in the second embodiment are arranged and the piezoelectric blocks 2 and 12 fabricated in the third embodiment are arranged in combination.

Although in the present embodiments the width direction of the piezoelectric block and the nozzle aligning direction are the same as each other, the same effects such as the image formation of high quality, the reliability and the low cost can be produced even if the directions are different from each other. In the case where the nozzle alignment and the arrangement of the piezoelectric blocks are deviated from each other with an appropriate angle, the nozzle pitch and the arrangement pitch of the pressure chambers can be absorbed so as to enhance the fabricating yield of the ink-jet recording head.

What is claimed is:

1. An ink-jet recording head comprising at least one piezoelectric block having (a) an ink pressure chamber communicating with a nozzle for ejecting ink supplied from an ink supply, (b) a partition wall serving as a driving portion that includes a piezoelectric element and at least two electrodes for driving said piezoelectric element, (c) a pressure buffer chamber, and (d) two fixed walls, wherein said ink pressure chamber, said partition wall and said pressure buffer chamber are respectively arranged in sequence along a thickness direction of said piezoelectric block, one of said fixed walls is disposed adjacent to said ink pressure chamber and another of said fixed walls is disposed adjacent to said pressure buffer chamber, and each of said fixed walls is more difficult to bend compared with said partition wall.

2. The ink-jet recording head as set forth in claim 1, wherein said piezoelectric block is a block molding molded integrally by baking powder including a piezoelectric material.

3. The ink-jet recording head as set forth in claim 2, wherein said block molding is molded by baking a lamination obtained by laminating sheets made of the powder and a binder.

4. The ink-jet recording head as set forth in claim 1, wherein a length of said fixed walls in the thickness direction is greater than that of said partition wall in the thickness direction.

5. The ink-jet recording head as set forth in claim 1, wherein each of said fixed walls includes a portion firmer than said partition wall.

6. An ink-jet recording head comprising:

at least one piezoelectric block (A) having (a) an ink pressure chamber (A) communicating with a nozzle (A) for ejecting ink supplied from an ink supply, (b) a partition wall (A) serving as a driving portion that includes a piezoelectric element (A) and at least two electrodes (A) for driving said piezoelectric element (A), (c) a pressure buffer chamber (A), and (d) two fixed walls (A); and at least one piezoelectric block (B) having (a) first and second ink pressure chambers (B), each ink pressure chamber (B) communicating with a nozzle (B) for ejecting ink supplied from an ink supply, (b) first and second partition walls (B), each partition wall (B) serving as a driving portion for one of the two ink pressure chambers, each partition wall (B) including a piezoelectric element (B) and at least two electrodes (B) for driving said piezoelectric element (B), (c) a pressure buffer chamber (B), and (d) first and second fixed walls (B), wherein said piezoelectric block (A) is configured such that said ink pressure chamber (A), said partition wall (A) and said pressure buffer chamber (A) are respectively arranged in sequence along a thickness direction, one of said fixed walls (A) is disposed adjacent to said ink pressure chamber (A) and another of said fixed walls is disposed adjacent to said pressure buffer chamber (A), said first ink pressure chamber (B), the first partition wall (B), said pressure buffer chamber (B), the second partition wall (B), and the second ink pressure chamber (B) are arranged in sequence along the thickness direction of said piezoelectric block (B), said first fixed wall (B) disposed adjacent to said first ink pressure chamber (B) and said second fixed wall (B) disposed adjacent to said second ink pressure chamber (B), and each of said fixed walls (A), (B) is more difficult to bend compared with each of said partition walls (A), (B).

7. The ink-jet recording head as set forth in claim 6, wherein said piezoelectric blocks (A) and (B) are block moldings molded integrally by baking powder including a piezoelectric material.

8. The ink-jet recording head as set forth in claim 7, wherein said block molding is molded by baking a lamination obtained by laminating sheets made of the powder and a binder.

9. The ink-jet recording head as set forth in claim 6, wherein a length of each of said fixed walls (A) and (B) in the thickness direction is greater than that of a respective partition wall (A) and (B) in the thickness direction.

10. The ink-jet recording head as set forth in claim 6, wherein each of said fixed walls (A) and (B) includes a portion firmer than a respective partition wall (A) and (B).

11. An ink-jet recording head comprising at least one piezoelectric block having (a) first and second ink pressure chambers, each pressure chamber communicating with a nozzle for ejecting ink supplied from an ink supply, (b) first and second partition walls, each partition wall serving as a driving portion for one of the two ink pressure chambers, each partition wall including a piezoelectric element and at least two electrodes for driving said piezoelectric element, (c) a pressure buffer chamber, and (d) first and second fixed walls, wherein at least one of said electrodes is embedded in said partition wall for controlling, by bending of the embedded electrode, whether said partition wall bends toward a side of said ink pressure chamber, or bends toward a side of said pressure buffer chamber, the first ink pressure chamber, the first partition wall, said pressure buffer chamber, the second partition wall and the second ink pressure chamber are arranged in sequence along a thickness direction of said piezoelectric block, said first fixed wall disposed adjacent to said first ink pressure chamber and said second fixed wall disposed adjacent to said second ink pressure chamber, the piezoelectric block is an integrally sintered one piece block structure, surfaces of the two electrodes are oriented perpendicular to the thickness direction, the driving portion is polarized in the thickness direction and perpendicular to the surfaces of the electrodes, each of said first and second fixed walls is more difficult to bend compared with each of said first and second partition walls, and a length of said fixed walls in the thickness direction is greater than that of said partition wall in the thickness direction.

12. An ink-jet recording comprising at least one piezoelectric block having (a) first and second ink pressure chambers, each pressure chamber communicating with a nozzle for electing ink supplied from an ink supply, (b) first and second partition walls, each partition wall serving as a driving portion for one of the two ink pressure chambers, each partition wall including a piezoelectric element and at least two electrodes for driving said piezoelectric element, (c) a pressure buffer chamber, and (d) first and second fixed walls, wherein at least one of said electrodes is embedded in said partition wall for controlling, by bending of the embedded electrode, whether said partition wall bends toward a side of said ink pressure chamber, or bends toward a side of said pressure buffer chamber, the first ink pressure chamber, the first partition wall, said pressure buffer chamber, the second partition wall and the second ink pressure chamber are arranged in sequence along a thickness direction of said piezoelectric block, said first fixed wall disposed adjacent to said first ink pressure chamber and said second fixed wall disposed adjacent to said second ink pressure chamber, the piezoelectric block is an integrally sintered one piece block structure, surfaces of the two electrodes are oriented perpendicular to the thickness direction, the driving portion is polarized in the thickness direction and perpendicular to the surfaces of the electrodes, each of said first and second fixed walls is more difficult to bend compared with each of said first and second partition walls, and each of said fixed walls includes a portion firmer than said partition wall.

13. An ink-jet recording head comprising at least one piezoelectric block having (a) first and second ink pressure chambers, each pressure chamber communicating with a nozzle for ejecting ink supplied from an ink supply, (b) first and second partition walls, each partition wall serving as a driving portion for one of the two ink pressure chambers, each partition wall including a piezoelectric element and at least two electrodes for driving said piezoelectric element, (c) a pressure buffer chamber, and (d) first and second fixed walls, wherein at least one of said electrodes is embedded in said partition wall for controlling, by bending of the embedded electrode, whether said partition wall bends toward a side of said ink pressure chamber, or bends toward a side of said pressure buffer chamber, the first ink pressure chamber, the first partition wall, said pressure buffer chamber, the second partition wall and the second ink pressure chamber are arranged in sequence along a thickness direction of said piezoelectric block, said first fixed wall disposed adjacent to said first ink pressure chamber and said second fixed wall disposed adjacent to said second ink pressure chamber, the piezoelectric block is an integrally sintered one piece block structure, surfaces of the two electrodes are oriented perpendicular to the thickness direction, the driving portion is polarized in the thickness direction and perpendicular to the surfaces of the electrodes, each of said first and second fixed walls is more difficult to bend compared with each of said first and second partition walls, and each of said fixed walls includes a hollow portion.

14. An ink-jet recording head comprising at least one piezoelectric block having (a) first and second ink pressure chambers, each pressure chamber communicating with a nozzle for ejecting ink supplied from an ink supply, (b) first and second partition walls, each partition wall serving as a driving portion for one of the two ink pressure chambers, each partition wall including a piezoelectric element and at least two electrodes for driving said piezoelectric element, (c) a pressure buffer chamber, and (d) first and second fixed walls, wherein at least one of said electrodes is embedded in said partition wall for controlling, by bending of the embedded electrode, whether said partition wall bends toward a side of said ink pressure chamber, or bends toward a side of said pressure buffer chamber, the first ink pressure chamber, the first partition wall, said pressure buffer chamber, the second partition wall and the second ink pressure chamber are arranged in sequence along a thickness direction of said piezoelectric block, said first fixed wall disposed adjacent to said first ink pressure chamber and said second fixed wall disposed adjacent to said second ink pressure chamber, the piezoelectric block is an integrally sintered one piece block structure, surfaces of the two electrodes are oriented perpendicular to the thickness direction, the driving portion is polarized in the thickness direction and perpendicular to the surfaces of the electrodes, each of said first and second fixed walls is more difficult to bend compared with each of said first and second partition walls, and said pressure buffer chamber communicates with an air inlet/outlet path connected outside of said recording head.

15. An ink-jet recording head comprising at least one piezoelectric block having (a) first and second ink pressure chambers, each pressure chamber communicating with a nozzle for electing ink supplied from an ink supply, (b) first and second partition walls, each partition wall serving as a driving portion for one of the two ink pressure chambers, each partition wall including a piezoelectric element and at least two electrodes for driving said piezoelectric element, (c) a pressure buffer chamber, and (d) first and second fixed walls, wherein at least one of said electrodes is embedded in said partition wall for controlling, by bending of the embedded electrode, whether said partition wall bends toward a side of said ink pressure chamber, or bends toward a side of said pressure buffer chamber, the first ink pressure chamber, the first partition wall, said pressure buffer chamber, the second partition wall and the second ink pressure chamber are arranged in sequence along a thickness direction of said piezoelectric block, said first fixed wall disposed adjacent to said first ink pressure chamber and said second fixed wall disposed adjacent to said second ink pressure chamber, the piezoelectric block is an integrally sintered one piece block structure, surfaces of the two electrodes are oriented perpendicular to the thickness direction, the driving portion is polarized in the thickness direction and perpendicular to the surfaces of the electrodes, and each of said first and second fixed walls is more difficult to bend compared with each of said first and second partition walls, a number of said electrodes is two, and both of said electrodes are embedded inside said partition wall.

16. The ink-jet recording head as set forth in claim 15, wherein one of said electrodes is disposed apart from said ink pressure chamber with a predetermined distance (L1), and the other electrode is disposed apart from said pressure buffer chamber with a predetermined distance (L2), the distance (L1) and (L2) satisfying the relationship of $L1 \neq L2$.

17. The ink-jet recording head as set forth in claim 15, wherein one of said electrodes is disposed apart from said ink pressure chamber with a predetermined distance (L1), and the other electrode is disposed apart from said pressure buffer chamber with a predetermined distance (L2), the distance (L1) and (L2) satisfying the relationship of $L1 > L2$.

18. An ink-jet recording head comprising at least one piezoelectric black having (a) first and second ink pressure chambers, each pressure chamber communicating with a nozzle for ejecting ink supplied from an ink supply, (b) first and second partition walls, each partition wall serving as a driving portion for one of the two ink pressure chambers, each partition wall including a piezoelectric element and at least two electrodes for driving said piezoelectric element, (c) a pressure buffer chamber, and (d) first and second fixed walls, wherein at least one of said electrodes is embedded in said partition wall for controlling, by bending of the embedded electrode, whether said partition wall bends toward a side of said ink pressure chamber, or bends toward a side of said pressure buffer chamber, the first ink pressure chamber, the first partition wall, said pressure buffer chamber, the second partition wall and the second ink pressure chamber are arranged in sequence along a thickness direction of said piezoelectric block, said first fixed wall disposed adjacent to said first ink pressure chamber and said second fixed wall disposed adjacent to said second ink pressure chamber, the piezoelectric block is an integrally sintered one piece block structure, surfaces of the two electrodes are oriented perpendicular to the thickness direction, the driving portion is polarized in the thickness direction and perpendicular to the surfaces of the electrodes, each of said first and second fixed walls is more difficult to bend compared with each of said first and second partition walls, and least one electrode is further interposed between said two electrodes.

19. An ink-jet recording head comprising at least one piezoelectric block having (a) first and second ink pressure chambers, each pressure chamber communicating with a nozzle for ejecting ink supplied from an ink supply, (b) first and second partition walls, each partition wall serving as a driving portion for one of the two ink pressure chambers, each partition wall including a piezoelectric element and at least two electrodes for driving said piezoelectric element, (c) a pressure buffer chamber, and (d) first and second fixed walls, wherein at least one of said electrodes is embedded in said partition wall for controlling, by bending of the embedded electrode, whether said partition wall bends toward a side of said ink pressure chamber, or bends toward a side of said pressure buffer chamber, the first ink pressure chamber, the first partition wall, said pressure buffer chamber, the second partition wall and the second ink pressure chamber are arranged in sequence along a thickness direction of said piezoelectric block, said first fixed wall disposed adjacent to said first ink pressure chamber and said second fixed wall disposed adjacent to said second ink pressure chamber, the piezoelectric block is an integrally sintered one piece block structure, surfaces of the two electrodes are oriented perpendicular to the thickness direction, the driving portion is polarized in the thickness direction and perpendicular to the surfaces of the electrodes, each of said first and second fixed walls is more difficult to bend compared with each of said first and second partition walls, a number of said electrodes is two, one of said electrodes is exposed to one of said ink pressure chamber and said pressure buffer chamber, and said electrode disposed at the surface exposed to said ink pressure chamber is grounded.

20. An ink-jet recording head comprising at least one piezoelectric block having (a) first and second ink pressure chambers, each pressure chamber communicating with a nozzle for electing ink supplied from an ink supply, (b) first and second partition walls, each partition wall serving as a driving portion for one of the two ink pressure chambers, each partition wall including a piezoelectric element and at least two electrodes for driving said piezoelectric element, (c) a pressure buffer chamber, and (d) first and second fixed walls, wherein at least one of said electrodes is embedded in said partition wall for controlling, by bending of the embedded electrode, whether said partition wall bends toward a side of said ink pressure chamber, or bends toward a side of said pressure buffer chamber, the first ink pressure chamber, the first partition wall, said pressure buffer chamber, the second partition wall and the second ink pressure chamber are arranged in sequence along a thickness direction of said piezoelectric block, said first fixed wall disposed adjacent to said first ink pressure chamber and said second fixed wall disposed adjacent to said second ink pressure chamber, the piezoelectric block is an integrally sintered one piece block structure, surfaces of the two electrodes are oriented perpendicular to the thickness direction, the driving portion is polarized in the thickness direction and perpendicular to the surfaces of the electrodes, each of said first and second fixed walls is more difficult to bend compared with each of said first and second partition walls, a portion at which said electrodes disposed at said partition wall face each other is included in a portion at which said ink pressure chamber and said pressure buffer chamber face each other, and a length of one of said electrodes in a direction perpendicular to the thickness direction is different from a length of the other electrode adjacent to said one electrode in the same direction.

21. The ink-jet recording head as set forth in claim 20, wherein one of said electrodes is included in a portion at which said ink pressure chamber and said pressure buffer chamber face each other, and the other electrode adjacent to said one electrode divides the portion at which said ink pressure chamber and said pressure buffer chamber face each other.

22. The ink-jet recording head as set forth in claim 21, wherein said adjacent dividing electrode is thicker than said one electrode.

23. An ink-jet recording head comprising at least one piezoelectric block having (a) first and second ink pressure chambers, each pressure chamber communicating with a nozzle for electing ink supplied from an ink supply, (b) first and second partition walls, each partition wall serving as a driving portion for one of the two ink pressure chambers, each partition wall including a piezoelectric element and at least two electrodes for driving said piezoelectric element, (c) a pressure buffer chamber, and (d) first and second fixed walls, wherein at least one of said electrodes is embedded in said partition wall for controlling, by bending of the embedded electrode, whether said partition wall bends toward a side of said ink pressure chamber, or bends toward a side of said pressure buffer chamber, the first ink pressure chamber, the first partition wall, said pressure buffer chamber, the second partition wall and the second ink pressure chamber are arranged in sequence along a thickness direction of said piezoelectric block, said first fixed wall disposed adjacent to said first ink pressure chamber and said second fixed wall disposed adjacent to said second ink pressure chamber, the piezoelectric block is an integrally sintered one piece block structure, surfaces of the two electrodes are oriented perpendicular to the thickness direction, the driving portion is polarized in the thickness direction and perpendicular to the surfaces of the electrodes, each of said first and second fixed walls is more difficult to bend compared with each of said first and second partition walls, and a length of said ink pressure chamber in a direction perpendicular to the thickness direction is different from a length of said pressure buffer chamber in the same direction.

24. An ink-jet recording head comprising at least one Piezoelectric block having (a) first and second ink pressure chambers, each pressure chamber communicating with a nozzle for ejecting ink supplied from an ink supply, (b) first and second partition walls, each partition wall serving as a driving portion for one of the two ink pressure chambers, each partition wall including a piezoelectric element and at least two electrodes for driving said piezoelectric element, (c) a pressure buffer chamber, and (d) first and second fixed walls, wherein at least one of said electrodes is embedded in said partition wall for controlling, by bending of the embedded electrode, whether said partition wall bends toward a side of said ink pressure chamber, or bends toward a side of said pressure buffer chamber, the first ink pressure chamber, the first partition wall, said pressure buffer chamber, the second partition wall and the second ink pressure chamber are arranged in sequence along a thickness direction of said piezoelectric block, said first fixed wall disposed adjacent to said first ink pressure chamber and said second fixed wall disposed adjacent to said second ink pressure chamber, the piezoelectric block is an integrally sintered one piece block structure, surfaces of the two electrodes are oriented perpendicular to the thickness direction, the driving portion is polarized in the thickness direction and perpendicular to the surfaces of the electrodes, each of said first and second fixed walls is more difficult to bend compared with each of said first and second partition walls, said piezoelectric block is repeatedly arranged in the thickness direction, and in a direction perpendicular to the thickness direction, and m nozzle alignments, in which said nozzles communicating with said ink pressure chambers are aligned in an arbitrary number in the same direction as the moving direction of said ink-jet recording head in an ink-jet printer, are arranged in a direction perpendicular to the moving direction, said nozzles are aligned without any overlapping in the direction perpendicular to the moving direction, and $X=P/m$, wherein X represents a deviation between said nozzles nearest each other out of said nozzles in reference to the moving direction, m represents an integer number of nozzles, and P represents a distance between said nozzles belonging to said same nozzle alignment.

25. The ink-jet recording head as set forth in claim 24, wherein the distance between said adjacent nozzle alignments in the direction perpendicular to the moving direction is a multiple of X.

26. The ink-jet recording head as set forth in claim 24, wherein the moving direction accords with the arranging direction of said ink pressure chamber and said pressure buffer chamber.

27. The ink-jet recording head as set forth in claim 24, wherein the moving direction does not accord with the arranging direction of said ink pressure chamber and said pressure buffer chamber.

* * * * *

UNITED STATES PATENT AND TRADEMARK OFFICE

CERTIFICATE OF CORRECTION

PATENT NO. : 6,783,211 B2
DATED : August 31, 2004
INVENTOR(S) : IGaki et al.

It is certified that error appears in the above-identified patent and that said Letters Patent is hereby corrected as shown below:

Title page,
Item [56], References Cited, FOREIGN PATENT DOCUMENTS, "JP 2-3311", delete "8/1990" and substitute -- 1/1990 --

Column 24,
Line 7, delete "electing" and substitute -- ejecting --

Column 25,
Line 43, delete "electing" and substitute -- ejecting --

Column 26,
Line 24, delete "black" and substitute -- block --

Column 27,
Line 32, delete "electing" and substitute -- ejecting --

Column 28,
Line 18, delete "electing" and substitute -- ejecting --
Line 52, delete "Piezoelectric" and substitute -- piezoelectric --

Signed and Sealed this

Nineteenth Day of April, 2005

JON W. DUDAS
*Director of the United States Patent and Trademark Office*